US006236167B1

(12) United States Patent
Yamaguchi et al.

(10) Patent No.: US 6,236,167 B1
(45) **Date of Patent: *May 22, 2001**

(54) APPARATUS FOR AND METHOD OF DRIVING ELEMENTS, APPARATUS FOR AND METHOD OF DRIVING ELECTRON SOURCE, AND IMAGE FORMING APPARATUS

(75) Inventors: Eiji Yamaguchi, Zama; Hidetoshi Suzuki, Fujisawa, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/204,261

(22) Filed: Dec. 3, 1998

(30) Foreign Application Priority Data

Dec. 3, 1997 (JP) ..... 9-333315
Nov. 24, 1998 (JP) ..... 10-332754

(51) Int. Cl.[7] ..... G09G 3/10

(52) U.S. Cl. ..... 315/169.2; 315/169.1; 315/169.3; 345/74; 345/94; 345/99

(58) Field of Search ..... 315/169.1, 169.2, 315/169.3, 167, 168, 337; 345/68, 74, 76, 77, 90, 94, 99

(56) References Cited

U.S. PATENT DOCUMENTS

| | | | |
|---|---|---|---|
| 4,316,123 | 2/1982 | Kleen et al. | 315/169.4 |
| 4,954,744 | 9/1990 | Suzuki et al. | 313/336 |
| 4,956,578 | 9/1990 | Shimizu et al. | 315/3 |
| 5,066,883 | 11/1991 | Yoshioka et al. | 313/309 |
| 5,155,416 | 10/1992 | Suzuki et al. | 315/366 |
| 5,530,314 | 6/1996 | Banno et al. | 313/310 |
| 5,627,436 | 5/1997 | Suzuki et al. | 315/169.1 |
| 5,645,462 | 7/1997 | Banno et al. | 445/51 |
| 5,650,795 | 7/1997 | Banno et al. | 345/74 |
| 5,734,361 * | 3/1998 | Suzuki et al. | 315/169.1 X |
| 5,838,097 | 11/1998 | Kasanuki et al. | 313/495 |

FOREIGN PATENT DOCUMENTS

| | | |
|---|---|---|
| 0762372A2 | 3/1997 | (EP) . |
| 64-31332 | 2/1989 | (JP) . |
| 1-232881 | 9/1989 | (JP) . |
| 2-257551 | 10/1990 | (JP) . |
| 4-87419 | 3/1992 | (JP) . |
| 09134147 | 5/1997 | (JP) . |

OTHER PUBLICATIONS

C.A. Spindt et al., "Physical Properties of Thin–Film Field Emission Cathodes With Molybdenum Cones", J. Appl. Phys., Dec. 1976, vol. 47, No. 12, pp. 5248–5263.

G. Dittmer, "Electrical Conduction and Electron Emission of Discontinuous Thin Films", Thin Solid Films, (1972), vol. 9, pp. 317–328.

(List continued on next page.)

*Primary Examiner*—Haissa Philogene
(74) *Attorney, Agent, or Firm*—Fitzpatrick, Cella, Harper & Scinto

(57) ABSTRACT

An apparatus for driving an electron emission element driven by two different potentials applied thereto includes a scanning drive circuit for applying a first potential to the electron emission element, a modulating drive circuit for applying a second potential to the electron emission element, and a timing control circuit for providing a delay time following application of the first potential in order to delay application of the second potential. The delay time is set to be longer than a time required for the damping of a ringing waveform, which is produced by application of the first potential, to 1% of the applied voltage. This makes it possible to reduce the effects of the ringing phenomenon.

100 Claims, 19 Drawing Sheets

OTHER PUBLICATIONS

C.A. Mead, "Operation of Tunnel Emission Devices", J. Appl. Phys., Apr. 1961, vol. 32, No. 4, pp. 646–652.

M.I. Elinson et al., "The Emission of Hot Electrons and the Field Emission of Electrons from Tin Oxide", Radio Engineering and Electronic Physics, Jul. 1965, 10, pp. 1290–1296.

Hisashi Araki et al., "Electroforming and Electron Emission of Carbon Thin Films", J. Vacuum Society of Japan, vol. 26, No. 1, pp. 22–29 (1983).

M. Hartwell et al., "Strong Electron Emission From Patterned Tin–Indium Oxide Thin Films", IEEE Trans. E.D. Conf., pp. 519–521 (1975).

W.P. Dyke et al., "Field Emission", Advances In Electronics and Electron Physics., vol. 8, pp. 89–185 (1956).

* cited by examiner

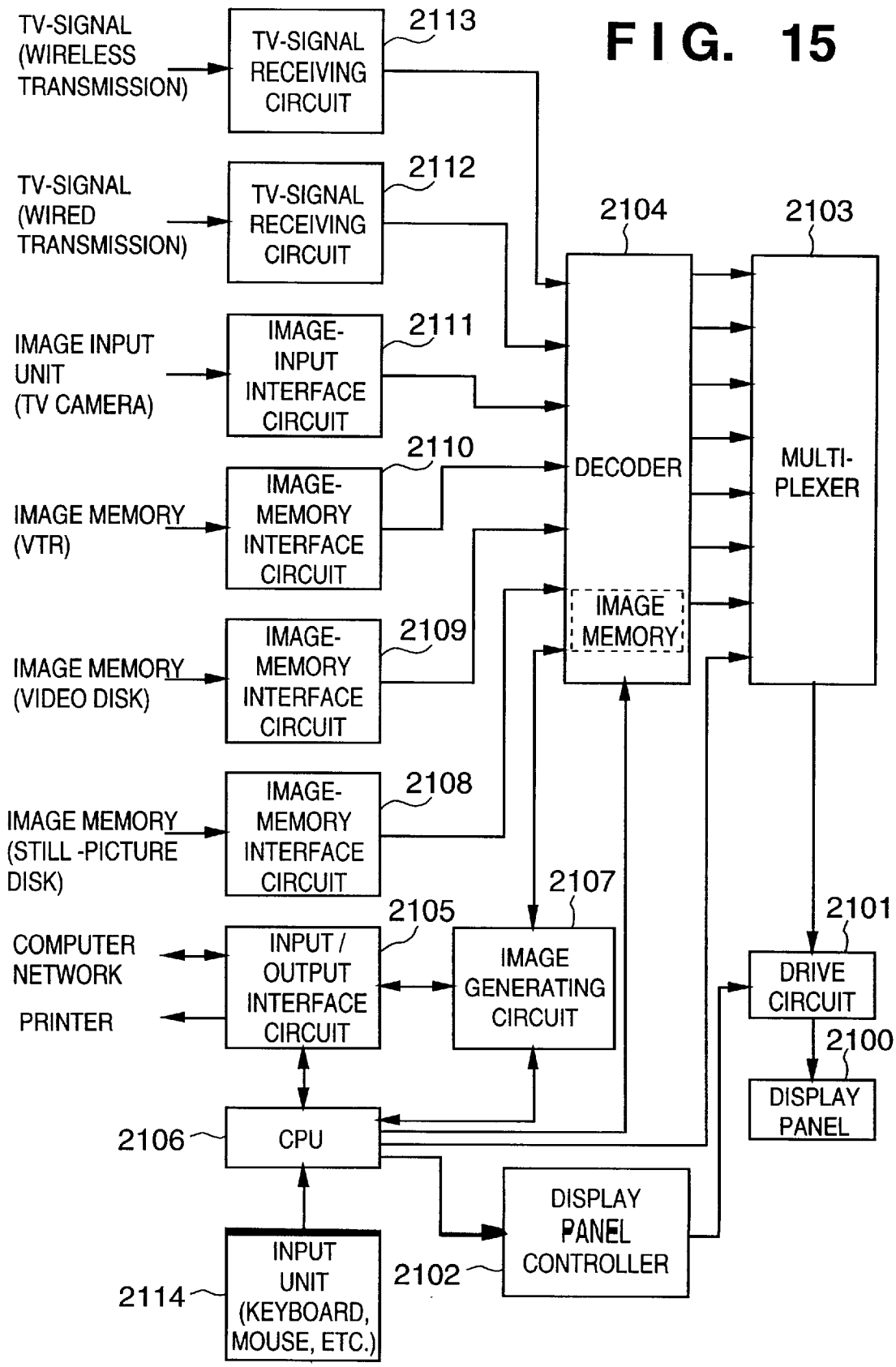
FIG. 15
TV-SIGNAL (WIRELESS TRANSMISSION)
TV-SIGNAL RECEIVING CIRCUIT
2113
TV-SIGNAL (WIRED TRANSMISSION)
TV-SIGNAL RECEIVING CIRCUIT
2112
IMAGE INPUT UNIT (TV CAMERA)
IMAGE-INPUT INTERFACE CIRCUIT
2111
IMAGE MEMORY (VTR)
IMAGE-MEMORY INTERFACE CIRCUIT
2110
IMAGE MEMORY (VIDEO DISK)
IMAGE-MEMORY INTERFACE CIRCUIT
2109
IMAGE MEMORY (STILL -PICTURE DISK)
IMAGE-MEMORY INTERFACE CIRCUIT
2108
COMPUTER NETWORK
PRINTER
INPUT / OUTPUT INTERFACE CIRCUIT
2105
IMAGE GENERATING CIRCUIT
2107
2104
DECODER
IMAGE MEMORY
2103
MULTI-PLEXER
2101
DRIVE CIRCUIT
2100
DISPLAY PANEL
2106
CPU
DISPLAY PANEL CONTROLLER
2102
2114
INPUT UNIT (KEYBOARD, MOUSE, ETC.)

APPARATUS FOR AND METHOD OF DRIVING ELEMENTS, APPARATUS FOR AND METHOD OF DRIVING ELECTRON SOURCE, AND IMAGE FORMING APPARATUS

BACKGROUND OF THE INVENTION

1. Field of the Invention

This invention relates to the driving of elements, especially the driving of electron emission elements and the driving of elements whose frequency of response is higher than the ringing frequency of a voltage applied thereto.

2. Description of the Related Art

Two types of elements, namely hot cathode elements and cold cathode elements, are known as electron emission elements. Examples of cold cathode elements are electron emission elements of the field emission type (abbreviated to "FE" below), metal/insulator/metal type (abbreviated to "MIM" below) and surface-conduction type.

Known examples of the FE type are described in W. P. Dyke and W. W. Dolan, "Field emission", Advance in Electron Physics, 8,89 (1956), and in C. A. Spindt, "Physical properties of thin-film field emission cathodes with molybdenum cones", J. Appl. Phys., 47, 5248 (1976).

A known example of the MIM type is described by C. A. Mead, "Operation of tunnel emission devices", J. Appl. Phys., 32, 646 (1961).

An example of the surface-conduction electron emission element is described by M. I. Elinson, Radio. Eng. Electron Phys., 10, 1290, (1965). There other examples as well, as will be described later.

The surface-conduction electron emission element makes use of a phenomenon in which an electron emission is produced in a small-area thin film, which has been formed on a substrate, by passing a current parallel to the film surface. Various examples of this surface-conduction electron emission element have been reported. One relies upon a thin film of $SnO_2$ according to Elinson, mentioned above. Other examples use a thin film of Au [G. Dittmer: "Thin Solid Films", 9, 317 (1972)]; a thin film of $In_2O_3/SnO_2$ (M. Hartwell and C. G. Fonstad: "IEEE Trans. E -D. Conf.", 519 (1975); and a thin film of carbon (Hisashi Araki, et al: "Vacuum", Vol. 26, No. 1, p. 22 (1983).

FIG. 16 is a plan view of the element according to M. Hartwell, et al., described above. This element construction is typical of these surface-conduction electron emission elements. As shown in FIG. 16, numeral 3001 denotes a substrate. Numeral 3004 denotes an electrically conductive thin film comprising a metal oxide formed by sputtering and is formed into a flat shape resembling the letter "H" in the manner illustrated. The conductive film 3004 is subjected to an electrification process referred to as "electrification forming", described below, whereby an electron emission portion 3005 is formed. The spacing L in FIG. 17 is set to 0.5–1 mm, and the spacing W is set to 0.1 mm. For the sake of illustrative convenience, the electron emission portion 3005 is shown to have a rectangular shape at the center of the conductive film 3004. However, this is merely a schematic view and the actual position and shape of the electron emission portion are not necessarily represented faithfully here.

In above-mentioned conventional surface-conduction electron emission elements, especially the element according to Hartwell, et al. , generally the electron emission portion 3005 is formed on the conductive thin film 3004 by the so-called "electrification forming" process before electron emission is performed. Electrification forming refers to the formation of an electron emission portion by the passage of current. By way of example, a constant DC voltage or a DC voltage which rises at a very slow rate on the order of 1 V/min is impressed across the conductive thin film 3004 to pass a current through the film, thereby locally destroying, deforming or changing the property of the conductive thin film 3004 and forming the electron emission portion 3005, the electrical resistance of which is very high. A crack is produced in part of the conductive thin film 3004 that has been locally destroyed, deformed or changed in property. Electrons are emitted from the vicinity of the crack if a suitable voltage is applied to the conductive thin film 3004 after electrification forming.

The surface-conduction electron emission element mentioned above is particularly simple in structure and easy to manufacture and therefore is advantageous in that a large number of elements can be formed over a large area. Accordingly, research has been directed to a method of arraying and driving a large number of elements, as disclosed in Japanese Patent Application Laid-Open No. 64-31332, filed by the applicant.

Further, applications of surface-conduction electron emission elements that have been researched are image forming devices such as image display devices and image recording devices, as well as charged beam sources, etc.

As for applications to image display devices, research has been conducted with regard to such devices using, in combination, surface-conduction type electron emission elements and phosphors which emit light in response to irradiation with an electron beam, as disclosed, for example, in the specifications of U.S. Pat. No. 5,066,833 and Japanese Patent Application Laid-Open (KOKAI) No. 2-257551 filed by the present applicant. The image display device using the combination of the surface-conduction type electron emission elements and phosphors is expected to have characteristics superior to those of the conventional image display device of other types. For example, in comparison with a liquid-crystal display device that has become so popular in recent years, the above-mentioned image display device emits its own light and therefore does not require backlighting. It also has a wider viewing angle.

SUMMARY OF THE INVENTION

The inventors have experimented with surface-conduction electron emission elements consisting of various materials, manufactured by various methods and having a variety of structures such as those described in the prior art above. Furthermore, the inventors have investigated multiple electron beam sources consisting of an array of a number of surface-conduction electron emission elements, and image display devices which employ these multiple electron beam sources.

The inventors have tried to produce a multiple electron beam source based upon an electrical wiring method illustrated in FIG. 17, by way of example. Specifically, this is a multiple electron beam source obtained by arraying a number of surface-conduction electron emission elements two dimensionally and wiring the elements in the form of a matrix in the manner illustrated.

In FIG. 17, numeral 4001 schematically illustrates a surface-conduction electron emission element, and numerals 4002, 4003 denote row-direction and column-direction wires, respectively. Though the row-direction wires 4002 and column-direction wires 4003 actually have limited electrical resistances, these are illustrated as wiring resistors 4004, 4005 in the drawing. This wiring shall be referred to as "simple matrix wiring".

The matrix is shown as a 6×6 matrix for the sake of illustration, though the size of the matrix is not limited to this. For example, in case of a multiple electron beam source for an image display device, enough elements for presenting a desired image display would be arrayed and wired.

In a multiple electron beam source obtained by wiring surface-conduction electron emission elements as a simple matrix, suitable electric signals are applied to the row-direction wires 4002 and column-direction wires 4003 in order to output the desired electron beams. For example, in order to drive the surface-conduction electron emission elements in any one row of the matrix, a selection voltage Vs is applied to the row-direction wire 4002 of the row to be selected and a non-selection voltage Vns is applied simultaneously to the row-direction wires 4002 of rows that are not to be selected. In synchronization with this operation, a driving voltage Ve for outputting an electron beam is applied to the column-direction wires 4003. In accordance with this method, a voltage of (Ve-Vs) is applied to the surface-conduction electron emission elements of the selected row and a voltage of (Ve-Vns) to the surface-conduction electron emission elements of the unselected rows if the voltage drop caused by the wiring resistances 4004 and 4005 is neglected. If Ve, Vs, Vns are made voltages of suitable sizes, electron beams of a desired intensity should be output solely by the surface-conduction electron emission elements of the selected row. If different driving voltages Ve are applied to respective ones of the column-direction wires, electron beams having different intensities should be output from respective ones of the elements of the selected row. Further, the speed of response of the surface-conduction electron emission elements is high. If the length of time the driving voltage Ve is applied is varied, therefore, then the length of time an electron beam is output should also be capable of being varied.

Accordingly, a multiple electron beam source having surface-conduction electron emission elements wired as a simple matrix has a variety of possible applications. For example, if an electric signal conforming to image information is suitably applied, then the multiple electron beam source can be used ideally as the electron source for an image display device.

In actuality, however, a multiple electron beam source having surface-conduction electron emission elements wired as a simple matrix involves the problems described below.

In order to output the desired electron beams, the selection voltage Vs is applied to the row-direction wire of the row to be selected and the driving voltage Ve for outputting the electron beams is applied simultaneously to the column-direction wires, as described above. In general, the driving signal on the scanning side (namely the signal Vs) is output in such a manner that the time during which it is applied overlaps the time during which the driving signal on the modulating side (namely the signal Ve) is applied, as illustrated in FIG. 18. This reduces the effects of any shift in the on/off timings of these driving signals.

A system comprising a display panel 4102 which uses a multiple electron beam source, a scanning drive circuit 4100, a modulating drive circuit 4101 and the connectors for connecting these circuits, as shown in FIG. 19A, has a capacitance component ascribed to the matrix wiring on the substrate of the multiple electron beam source, a resistance component due to the surface-conduction electron emission elements, and inductance components from the wiring. If the system of FIG. 19A is replaced by a simple electric circuit that is the equivalent, the result is as shown in FIG. 19B. A signal source V1 represents the scanning drive circuit 4100, a signal source V2 the modulating drive circuit 4101, L1 and L2 the inductance components of the connections, C the capacitance component between the matrix wires on the substrate of the multiple electron beam source, and R the resistance component of the surface-conduction electron emission elements. For the sake of simplicity, the inductance components of the matrix wiring is assumed to be so small as to be negligible.

In the circuit of FIG. 19B, a driving signal of the kind shown in FIG. 20 is applied to a surface-conduction electron emission element when the rectangular waves shown in FIG. 18 are applied to the display panel 4102 as the driving signals by the scanning drive circuit 4100 and modulating drive circuit 4101. As illustrated in FIG. 20, a voltage V is applied to the element. More specifically, first the selection voltage Vs is output by the scanning drive circuit 4100 and then the driving voltage Ve is output by the scanning drive circuit 4100, so that the total voltage V applied is Ve-Vs. The encircled areas A and B illustrate partial enlargements of the signal waveform when the pulse rises. Ringing due to the LC components is produced at the positive- and negative-going transitions of the driving pulses. The amplitudes of ringing at the portions A and B differ for reasons described later.

Problems caused by the ringing mentioned above are degraded controllability of electron emission current and deterioration caused by application of excessive voltage to the surface-conduction electron emission elements.

An object of the present invention is to make it possible to mitigate the effects of ringing described above.

According to the present invention, the foregoing object is attained by providing a drive apparatus for driving an electron emission element driven by two different potentials applied thereto, comprising: first application means for applying a first potential to the electron emission element; second application means for applying a second potential to the electron emission element; and delay means for providing a delay time following application of the first potential in order to delay application of the second potential; the delay time being set to be longer than a time required for a ringing waveform, which is produced by application of the first potential, to be damped to 1%.

According to another aspect of the present invention, the foregoing object is attained by providing a drive apparatus for driving an electron source device obtained by connecting, by wiring, an electron emission element driven by two different potentials applied thereto, comprising: first application means for applying a first potential to the electron emission element; second application means for applying a second potential to the electron emission element; and delay means for providing a delay time Td following application of the first potential in order to delay application of the second potential; the delay time Td satisfying the following inequality when R, C and L represent a resistance value, capacitance component and inductance component of the electron source device, respectively:

$$Td>(0.733/\zeta)\times(2\pi/\omega_0)$$

where $$\zeta=1/(2R)\times\sqrt{(L/C)},\ \omega_0=\sqrt{(L/C)}$$

According to another aspect of the present invention, the foregoing object is attained by providing a drive apparatus for driving an electron emission element driven by two different potentials applied thereto, comprising: first application means for applying a first potential to the electron emission element; second application means for applying a second potential to the electron emission element; and delay means for providing a delay time following application of the first potential in order to delay application of the second potential; the delay time being set to be longer than a time required for a ringing waveform, which is produced by application of the first potential, to be damped so that when the second potential is applied, the electron emission element will no longer be destroyed by a voltage that is the difference between the two potentials applied to the electron emission element.

According to another aspect of the present invention, the foregoing object is attained by providing a drive apparatus for driving an electron emission element driven by two different potentials applied thereto, comprising: first application means for applying a first potential to the electron emission element; second application means for applying a second potential to the electron emission element; and delay means for providing a delay time following application of the first potential in order to delay application of the second potential; the delay time being set to be longer than a time required for a ringing waveform, which is produced by application of the first potential, to be damped so that when the second potential is applied, a change in a characteristic of the electron emission element caused by a voltage that is the difference between the two potentials applied to the electron emission element will fall within an allowable range.

According to another aspect of the present invention, the foregoing object is attained by providing a drive apparatus for driving an electron emission element driven by two different potentials applied thereto, comprising: first application means for applying a first potential to the electron emission element; second application means for applying a second potential to the electron emission element; and delay means for providing a delay time following application of the first potential in order to delay application of the second potential; the delay time being set to be longer than a time required for a ringing waveform, which is produced by application of the first potential, to be damped so that when the second potential is applied, a change in state of drive of the electron emission element caused by a voltage that is the difference between the two potentials applied to the electron emission element will fall within an allowable range.

According to another aspect of the present invention, the foregoing object is attained by providing a drive apparatus for driving an element driven by two different potentials applied thereto, the element having a response frequency greater than a ringing frequency of the potentials applied, comprising: first application means for applying a first potential to the element; second application means for applying a second potential to the element; and delay means for providing a delay time following application of the first potential in order to delay application of the second potential; the delay time being set to be longer than a time required for a ringing waveform, which is produced by application of the first potential, to be damped to 1%.

It should be noted that the "frequency of response" of an element refers to the maximum frequency at which it is possible to follow up a change in the state of drive caused by a fluctuation in the voltage applied to the element. The present invention is particularly useful for elements having a quick response time to fluctuations in voltage and to elements which react also to fluctuations in potential caused by ringing.

According to another aspect of the present invention, the foregoing object is attained by providing a drive apparatus for driving an electron source device obtained by connecting, by wiring, an element driven by two different potentials applied thereto, comprising: first application means for applying a first potential to the element; second application means for applying a second potential to the element; and delay means for providing a delay time Td following application of the first potential in order to delay application of the second potential; the delay time Td satisfying the following inequality when R, C and L represent a resistance value, capacitance component and inductance component of the electron source device, respectively:

$$Td>(0.733/\zeta)\times(2\pi/\omega_0)$$

where $$\zeta=1/(2R)\times\sqrt{(L/C)},\ \omega_0\sqrt{(L/C)}$$

the element having a response frequency that is greater than $\omega_0$.

According to another aspect of the present invention, the foregoing object is attained by providing a drive apparatus for driving an element driven by two different potentials applied thereto, the element having a response frequency greater than a ringing frequency of the potentials applied, comprising: first application means for applying a first potential to the element; second application means for applying a second potential to the element; and delay means for providing a delay time following application of the first potential in order to delay application of the second potential; the delay time being set to be longer than a time required for a ringing waveform, which is produced by application of the first potential, to be damped so that when the second potential is applied, the electron emission element will no longer be destroyed by a voltage that is the difference between the two potentials applied to the electron emission element.

According to another aspect of the present invention, the foregoing object is attained by providing a drive apparatus for driving an element driven by two different potentials applied thereto, the element having a response frequency greater than a ringing frequency of the potentials applied, comprising: first application means for applying a first potential to the element; second application means for applying a second potential to the element; and delay means for providing a delay time following application of the first potential in order to delay application of the second potential; the delay time being set to be longer than a time required for a ringing waveform, which is produced by application of the first potential, to be damped so that when the second potential is applied, a change in a characteristic of the electron emission element caused by a voltage that is the difference between the two potentials applied to the electron emission element will fall within an allowable range.

According to another aspect of the present invention, the foregoing object is attained by providing a drive apparatus for driving an element driven by two different potentials applied thereto, the element having a response frequency greater than a ringing frequency of the potentials applied, comprising: first application means for applying a first potential to the element; second application means for applying a second potential to the element; and delay means for providing a delay time following application of the first potential in order to delay application of the second potential; the delay time being set to be longer than a time required for a ringing waveform, which is produced by application of the first potential, to be damped so that when the second potential is applied, a change in state of drive of the electron emission element caused by a voltage that is the difference between the two potentials applied to the electron emission element will fall within an allowable range.

As mentioned above, the delay time is set so that the difference between the two potentials is smaller than a predetermined value. The delay time may be determined so that the difference between the first and second potentials, which includes the sum of 1) an amplitude of a ringing waveform generated by applying the second potential and 2) an amplitude of ringing waveform generated by applying the first potential, which remains at the time the second potential is applied, falls within an allowable range.

The above determination of the delay time is effective if influence of ringing wave is significant at the time the second potential is applied.

Preferably, the first potential to a row-direction wire of a multiple-element device obtained by wiring a plurality of said elements two-dimensionally into a matrix, and the second application means applies the second potential to a column-direction wire of the multiple-element device in state in which the first potential is being applied by the first application means.

More preferably, the first application means applies the first potential to a plurality of row-direction wires while selecting these row-direction wires sequentially.

More preferably, the second application means applies the second potential based upon an image signal.

More preferably, the first and second potentials are set to values that will not cause the element to be driven when the first potential is being applied and the second potential is not.

It is preferable to set the first and second potentials so that the element emits electrons when the first and second potentials are applied and the element does not emit electrons when the first potential is applied and the second potential is not applied (or another potential is applied).

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 15 is a block diagram showing a multifunction image display apparatus using an image display device embodying the present invention;

DESCRIPTION OF THE PREFERRED EMBODIMENTS

Preferred embodiments of the present invention will now be described with reference to the drawings.

Figure 1:
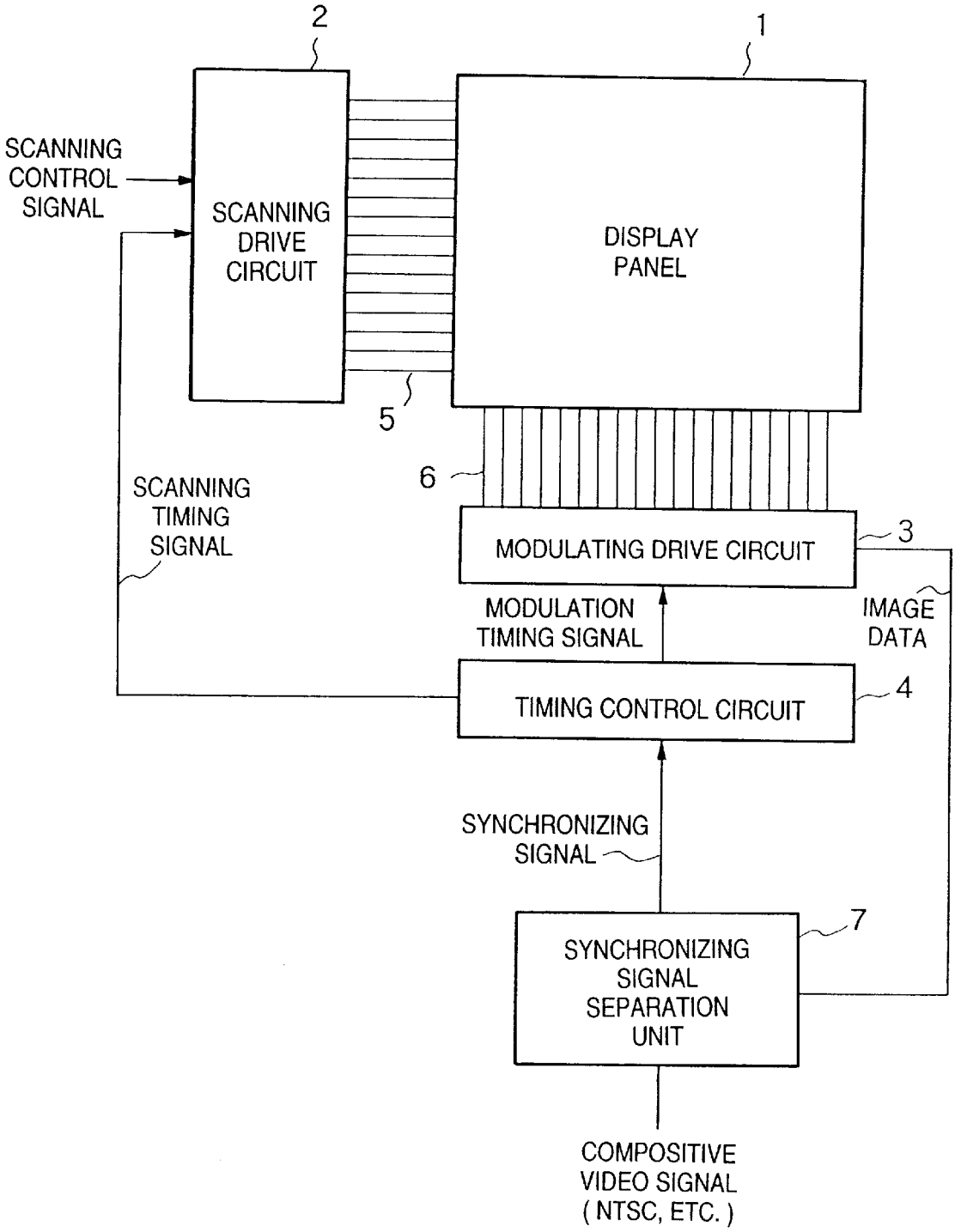
FIG. 1 is a diagram showing the drive circuitry of a display panel that is part of an image forming apparatus according to an embodiment of the present invention.

FIG. 1 illustrates the drive circuits of an image forming apparatus according to a preferred embodiment of the invention. Specifically, shown in FIG. 1 are a display panel 1 which uses a multiple electron beam source, a scanning drive circuit 2 for performing drive so as to scan selected lines to present a line sequential display, a modulating drive circuit 3 for outputting a modulating signal based upon an image, a timing control circuit 4 for controlling the timing at which the modulating signal is applied to the display panel 1, and connections 5, 6 between the display panel 1 and drive circuits 2, 3.

Numeral 7 denotes a synchronizing signal separation unit which separates composite video signals into synchronizing signals and image data signals. The image data signals are supplied to the modulating drive circuit 3. The synchronizing signals are supplied to the timing control circuit 4. The timing control circuit 4 generates "B" and "D" based on the synchronizing signal and supplies them to the scanning drive circuit 2 and modulating drive circuit 3, respectively.

As mentioned earlier, the driving signals applied to the electron emission elements develop ringing owing to a capacitance component ascribable to the matrix wiring on the substrate of the multiple electron beam source and inductance components due to induction in the connections between the electron source substrate and drive circuits. According to this embodiment, the timing control circuit 4 controls the application timing of the modulating signal in such a manner that the driving voltage from the modulating drive circuit 3 will be applied after the ringing of the driving voltage waveform, which is produced when the selection voltage from the scanning drive circuit 2 is applied, subsides. By thus controlling the timing at which the driving voltage is applied by the modulating drive circuit 3, the effects of ringing are reduced.

In terms of operation of the circuit shown in FIG. 1, first the selection voltage from the scanning drive circuit 2 is applied to the desired line in accordance with a scanning control signal. Next, the driving voltage is applied from the modulating drive circuit 3 based on the image data signal corresponding to the selected line. The timing for applying the driving voltage is delayed by the timing control circuit 4 which provides a delay time that is longer than the time needed for settling of the rising of the driving signal caused by the selection voltage. A display is presented by performing this operation in regard to each line selected by sequential scanning.

Figure 2:
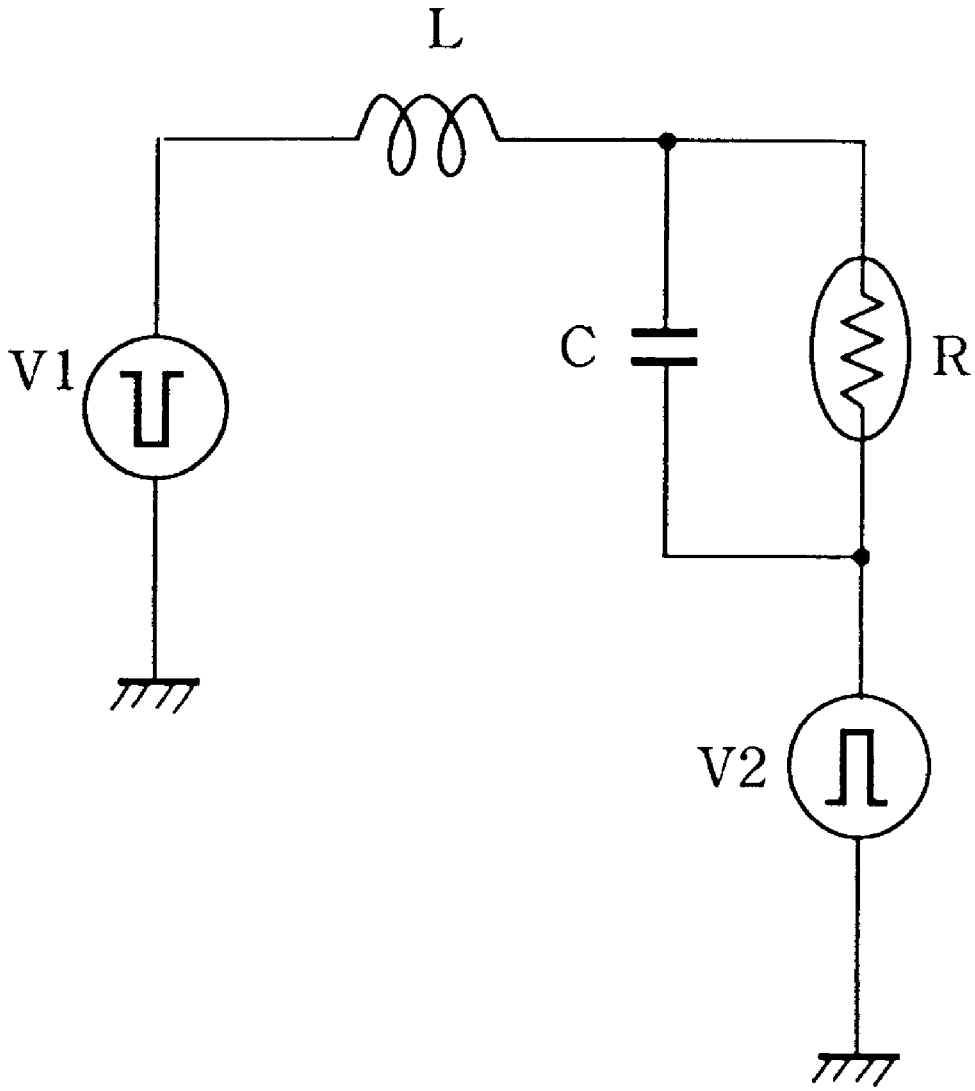
FIG. 2 is an equivalent circuit diagram useful in describing the electrical characteristics of an electron source, drive circuit and connections shown in FIG. 1.
Figure 3:
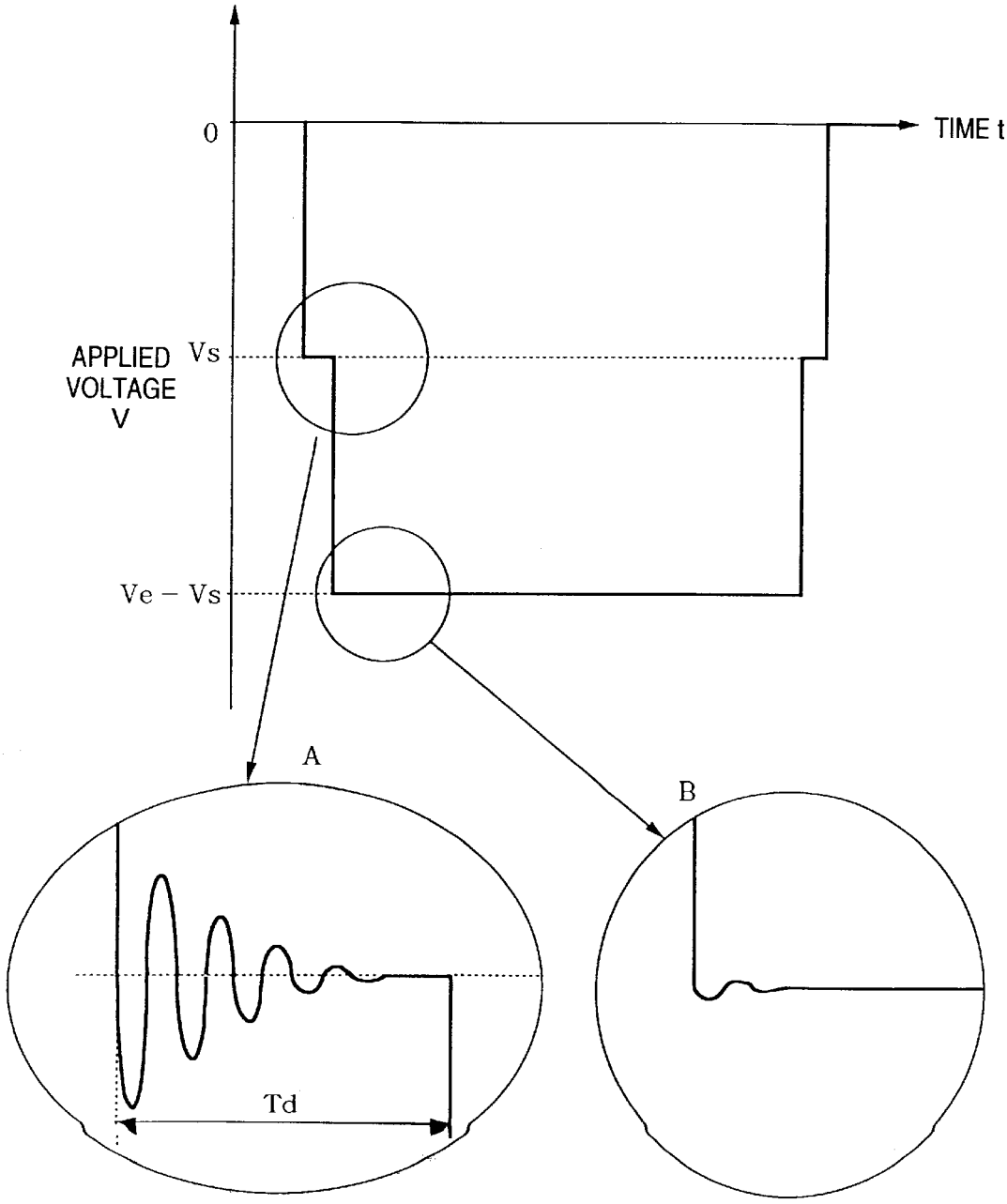
FIG. 3 is a diagram useful in describing a transient signal waveform applied to the electron source.

A desired delay time according to this embodiment will be described with reference to FIGS. 2 and 3. FIG. 2 is a diagram obtained when the circuitry of FIG. 1 is replaced by a simplified electric circuit. Here L is substituted for the inductance components of the connections 5, 6 and matrix wiring on the substrate of the electron beam sources, C is substituted for the capacitance component and R is substituted for the resistance components of the plurality of surface-conduction electron emission elements on the selected line. Under these conditions it is possible to calculate the ringing waveform expressed by the following equation, where $\omega_0$ represents the angular frequency of ringing, $\zeta$ the damping coefficient and V(t) the voltage applied to the surface-conduction electron emission elements:

$$V(t)=1-[\zeta/\sqrt{(1\zeta^2)}\ *\sin(1-\zeta^2)$$

$$*\omega_0 t+\cos(\sqrt{(1\zeta^2)}*(\omega_0 t)]*\exp(-\zeta\omega_0 t)$$

where $$\omega_0=\sqrt{(L\times C)}$$

$$\zeta=1/(2R)\times\sqrt{(L/C)}$$

Let Td represent the desired delay time. The component representing damping of the ringing waveform in the above equation for calculating V(t) is $$\exp(-\zeta\omega_0 t)$$

A time t1 that will make $\exp(-\zeta\omega_0 t)$ approximately 0.01 (i.e., 1%) should be selected. In other words, we have $$\exp(-\zeta\omega_0 t)=0.01$$

Accordingly, this gives us $$t1=4.605(\zeta\omega_0)$$

Further, since $\omega_0=2\pi f_0$ holds, we have $$t1=0.733/(\zeta f_0)$$

By selecting a delay time Td that is larger than t1, the transient voltage added upon the applied voltage by the ringing waveform can be damped to less than 1%. The delay time Td may be written as follows for the sake of simplicity:

$$Td>1/(\zeta f_0)[=1/\zeta\times(2\pi/\omega_0)]$$

The inductance component L that decides $\omega_0$ and $\zeta$ is determined by the wiring length of the circuit, and the capacitance component C is decided primarily by the capacitance component of the insulating layer at the matrix wiring intersections and the capacitance component due to the capacitance between neighboring wiring patterns. The resistance component R is determined by the ON resistance of the elements when they are turned on and the OFF resistance of the elements when they are turned off. These components are parameters fixed based on the arrangement and dimension of the multiple electron beam source and the matrix wiring on the substrate.

The inductance component L is decided by the wiring length of the circuit, as mentioned above, and can be measured by an LCR meter by selecting one line of the wiring for the scanning and using the lead-outs on both sides of this line as terminals. The inductance component due to the wiring on the modulating side can be measured in similar fashion. However, since several thousand wiring patterns on the modulating side are selected simultaneously when the elements are driven, the inductance components of each of the lines become parallel-connected and, hence, take on extremely small values. The capacitance component C is decided primarily by the capacitance component of the insulating layer at the matrix wiring intersections and the capacitance component due to the capacitance between neighboring wiring patterns, as mentioned above. In other words, in a manner similar to that when the elements are driven, the capacitance component C can be measured by an LCR meter by using one selected wiring pattern on the scanning side as one terminal and using the remaining wiring patterns on the scanning side and all wiring patterns on the modulating side collectively as the other terminal. The resistance component R is determined by the ON resistance of the elements when they are turned on and the OFF resistance of the elements when they are turned off, as mentioned above. In other words, the ON resistance can be measured by dividing, by the line current that flows into the scanning side, a value obtained by adding the applied voltage on the scanning side when a line is selected so as to turn on the elements of this line and the voltage (namely the total selection voltage) applied to all elements on the selected line from the modulating side. The OFF resistance can be measured upon turning off the ON elements, as by making the voltage on the modulating side zero, in such a manner that the selection voltage applied to all elements on the selected line will be half of the voltage applied when the elements were in the ON state.

The value of Td mentioned above is decided in such a manner that voltage due to ringing will not exceed 1% of the applied voltage. This means that if the applied voltage at the time of turn-on is 14 V, then the voltage due to ringing will be 0.14 V. This level is the same as the margin, e.g., 0.25 V, of the driving voltage that may be assumed from the temperature characteristic and output variance of the drive circuit. In other words, since the set driving margin is taken by ringing, it is required that the settled state of the transient waveform due to ringing be limited to be on the order of several percent of the applied voltage. Accordingly, it will suffice if the delay time Td is decided so that the voltage due to ringing will not be more than several percent of the applied voltage, the value of 1% mentioned above not being a strict limitation.

We shall investigate the aforementioned L, C, R values in an image display device having a diagonal size of 60 inches provided with an RGB pixel array of 2000 horizontal pixels×1000 vertical pixels necessary for a high-quality image display. The lengths of the scanning wiring patterns and modulating wiring are 1.3 m and 0.7 m, respectively, and the capacitance component due to the scanning wiring that mainly decides the inductance component is about one gH. The capacitance component at the wiring cross points is 0.02 pF per cross point in a case where the width of the scanning wiring is about 300 $\mu$m, the width of the modulating wiring is about 100 $\mu$m and the thickness of the insulating layer is about 20 $\mu$m. Capacitance when one scanning line having an array of 2000×3 elements is selected is 120 pF. Here the capacitance between neighboring scanning lines is assumed to be relatively small. Further, OFF resistance is 3 MΩ per element in view of the voltage-current characteristic of the element. Accordingly, the off resistance is about 500 Ω per elements on the line. This means that the resonance frequency when the elements on one line of the matrix are driven is 14 MHz, based upon $1/[2\pi\sqrt{(L\times C)}]$. Further, $\zeta$ is 0.09 and Td serving as the standard is five microseconds. With regard to element response, operation is based upon tunnel current. Therefore, since rise time is on the order of nanoseconds, the elements operate in conformity with the above-described ringing waveform.

The setting of the delay time Td influences the maximum brightness of the light emission because the delay time and maximum modulation time share the scanning interval of one line. More specifically, maximum brightness is decided by the time to be driven in a duration of the line scanning. For example, if the display frame frequency is 60 Hz and the number of scanning lines is 1000, then one scanning interval is about 17 $\mu$s. If a delay time Td of 5 $\mu$s has been set, maximum brightness will be reduced by about 30% based upon the equation $5/17=0.29$. It is preferred that this embodiment be implemented by setting the amount of reduction to be less than 50%. In other words, the delay time Td should be made less than 50%, and preferably less than 30%, of the time during which the first potential is applied.

As will be described later, surface-conduction electron emission elements according to this embodiment have a resistance component that exhibits a non-linear characteristic with respect to applied voltage. That is, the element exhibits a comparatively high resistance value when only the selection voltage Vs is being applied, and the resistance value decreases by one place when the driving voltage Ve is applied in addition to Vs. In driving a simple matrix, the usual practice is to select these voltages in accordance with the equation $-Vs=Ve=\frac{1}{2}(Ve-Vs)$. A surface-conduction electron emission element will exhibit a high resistance value when only Vs is applied and a low resistance value when Vs and Ve are applied.

This change in the resistance component with respect to applied voltage means that the value of the damping coefficient $\zeta$ in the ringing phenomenon changes. As a result, a difference is produced in the damping characteristic of the ringing waveform. This is shown in FIG. 3. Ringing continues for a comparatively long time and the amplitude thereof is large during the time that only the selection voltage Vs is being applied. However, since the driving voltage Ve is applied upon being delayed by the delay time Td, which is longer than the time required for ringing to settle, the effects of ringing are negligible. In the case where the driving voltage Ve is applied, the damping coefficient $\zeta$ becomes several times larger. Consequently, ringing subsides quickly and becomes small in amplitude, as indicated at B in FIG. 3. This means that measures taken when only the selection voltage Vs is applied are effective in order to suppress the effects of ringing.

By reducing the effects of ringing at the time of drive in the manner described above, it is possible to obtain a high-quality image forming apparatus whose gradation property is controlled.

Construction and Method of Manufacturing Display Panel

The construction of a display panel of an image display apparatus, as well as a method of manufacturing the panel, according to this embodiment of the present invention will now be described.

Figure 4:
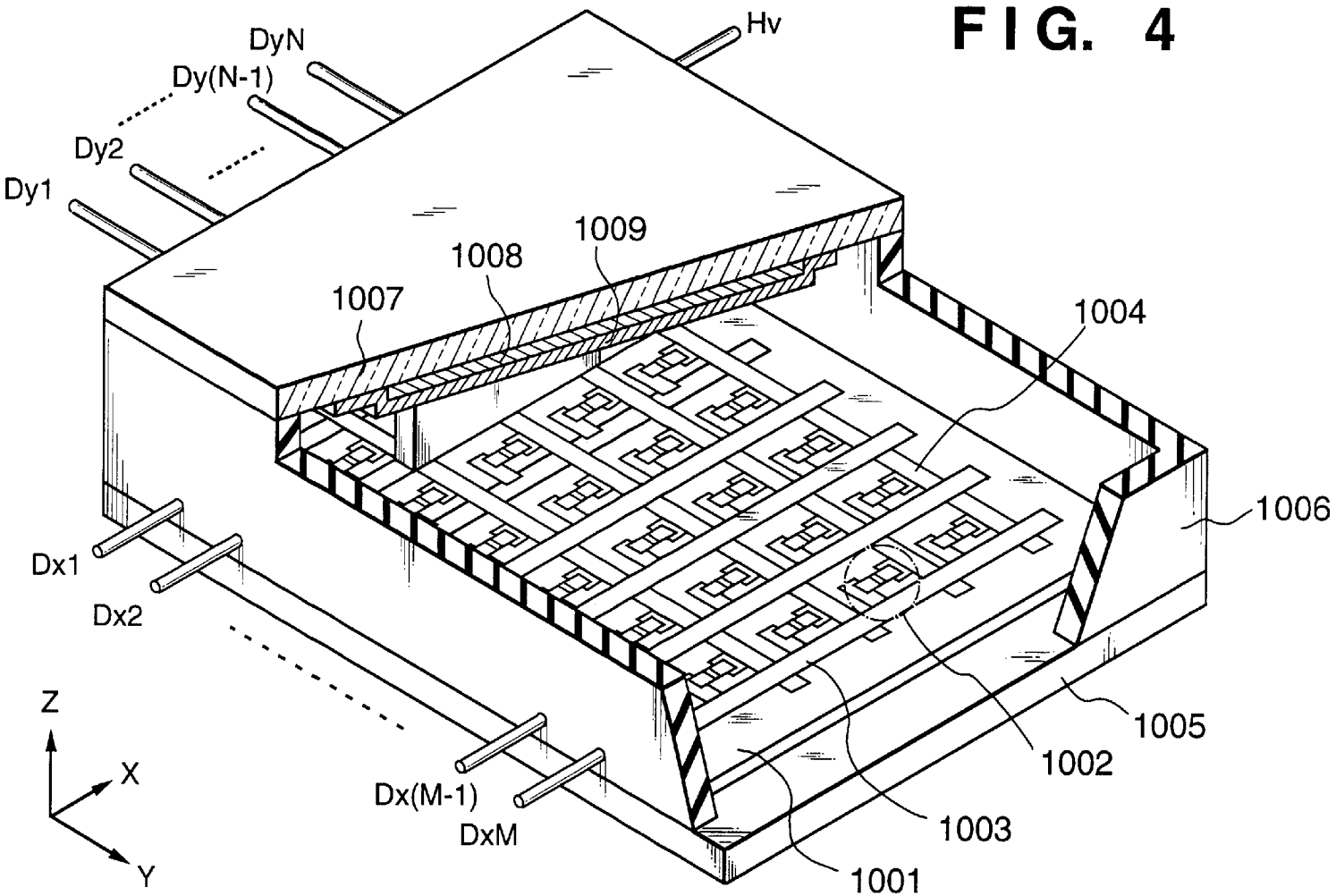
FIG. 4 is a perspective view, partially cut away, showing the display panel of an image display device according to an embodiment of the present invention.

FIG. 4 is a perspective view of the display panel used in this embodiment. Part of a panel is cut away to reveal the internal structure of the apparatus.

The apparatus includes a rear plate 1005, a side wall 1006 and a face plate 1007. The rear plate 1005, side wall 1006 and face plate 1007 form a hermetic envelope for maintaining a vacuum within the display panel. In terms of assembling the hermetic vessel, the joints between the members require to be sealed to maintain sufficient strength and air-tightness. By way of example, a seal is achieved by coating the joints with frit glass and carrying out calcination in the atmosphere or in a nitrogen environment at a temperature of 400~500° C. for 10 min or more. The method of evacuating the interior of the hermetic vessel will be described later.

A substrate 1001 is fixed to the rear plate 1005, which substrate has N×M surface-conduction electron emission elements 1002 formed thereon. (Here N, M are positive integers having a value of two or greater, with the number being set appropriately in conformity with the number of display pixels intended. For example, in a display apparatus the purpose of which is to display high-definition television, it is desired that the set numbers of elements be no less than N=3000, M=1000. In this embodiment, N=3072, M=1024 hold.) The N×M surface-conduction electron emission elements are matrix-wired by m-number of row-direction wiring patterns 1003 and n-number of column-direction wiring patterns 1004. The portion constituted by the components 1001~1004 is referred to as a "multiple electron beam source". The method of manufacturing the multiple electron beam source and the structure thereof will be described later in greater detail.

In this embodiment, the structure is such that the substrate 1001 of the multiple electron beam source is fixed to the rear plate 1005 of the hermetic envelope. However, in a case where the substrate 1001 of the multiple electron beam source has sufficient mechanical strength, the substrate 1001 may itself be used as the rear plate of the hermetic envelope.

Figure 5A:
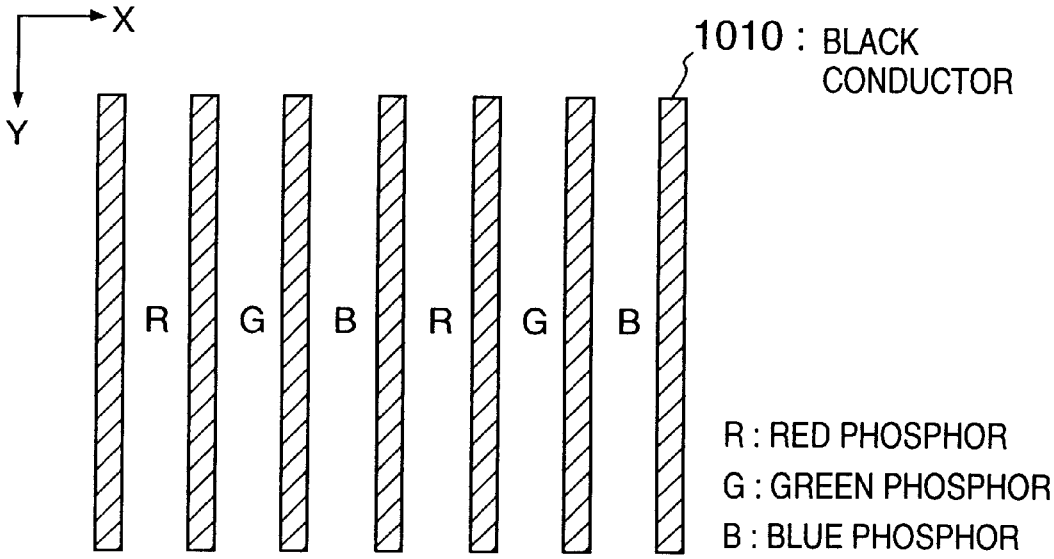
FIGS. 5A and 5B are plan views showing an array of phosphors on a face plate of the display panel.

A phosphor film 1008 is formed on the underside of the face plate 1007. Since this embodiment relates to a color display apparatus, portions of the phosphor film 1008 a recoated with phosphors of the three primary colors red, green and blue used in the field of CRT technology. The phosphor of each color is applied in the form of stripes, as shown in FIG. 5A, and a black conductor 1010 is provided between the phosphor stripes. The purpose of providing the black conductors 1010 is to assure that there will not be a shift in the display colors even if there is some deviation in the position irradiated with the electron beam, to prevent a decline in display contrast by preventing the reflection of external light, and to prevent the phosphor film from being charged up by the electron beam. Though the main ingredient used in the black conductor 1010 is graphite, any other material may be used so long as it is suited to the above-mentioned objectives.

Figure 5B:
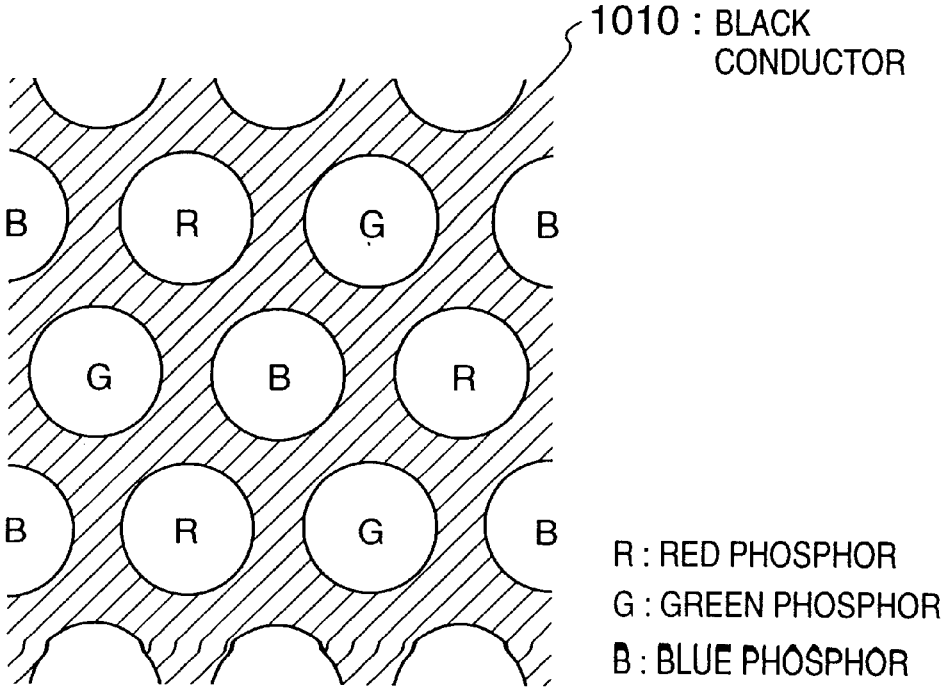

The application of the phosphors of the three primary colors is not limited to the stripe-shaped array shown in FIG. 5A. For example, a delta-shaped array, such as that shown in FIG. 5B, or other array may be adopted.

In a case where a monochromatic display panel is fabricated, a monochromatic phosphor material may be used as the phosphor film 1008 and the black conductor material need not necessarily be used.

Further, a metal back 1009 well known in the field of CRT technology is provided on the surface of the phosphor film 1008 on the side of the rear plate. The purpose of providing the metal back 1009 is to improve the utilization of light by reflecting part of the light emitted by the phosphor film 1008, to protect the phosphor film 1008 against damage due to bombardment by negative ions, to act as an electrode for applying an electron-beam acceleration voltage, and to act as a conduction path for the electrons that have excited the phosphor film 1008. The metal back 1009 is fabricated by a method which includes forming the phosphor film 1008 on the face plate substrate 1007, subsequently smoothing the surface of the phosphor film and vacuum-depositing aluminum on this surface. In a case where a phosphor material for low voltages is used as the phosphor film 1008, the metal back 1009 is unnecessary.

Though not used in this embodiment, transparent electrodes made of a material such as ITO may be provided between the face plate substrate 1007 and the phosphor film 1008 in order to apply an accelerating voltage and for the purpose of improving the conductivity of the phosphor film 1008.

Electrical connection terminals Dx1~DxM, Dyl~DyN and Hv having an air-tight structure are provided to electrically connect the display panel to an electric circuit, which is not shown. The terminals Dx1~Dxm are electrically connected to the row-direction wiring patterns 1003 of the multiple electron beam source, the terminals Dy1~DyN are electrically connected to the column-direction wiring patterns 1004 of the multiple electron beam source, and the terminal Hv is electrically connected to the metal back 1009 of the face plate.

In order to evacuate the interior of the hermetic envelope, an exhaust pipe and a vacuum pump, not shown, are connected to the hermetic envelope after the hermetic envelope is assembled and the interior of the envelope is exhausted to a vacuum of $1\times10^{-7}$ torr. The exhaust pipe is then sealed. In order to maintain the degree of vacuum within the hermetic envelope, a getter film (not shown) is formed at a prescribed position inside the hermetic envelope immediately before or immediately after the pipe is sealed. The getter film is a film formed by heating a getter material, the main ingredient of which is Ba, for example, by a heater or by high-frequency heating to deposit the material. A vacuum on the order of $1\times10^{-5}$~$1\times10^{-7}$ torr is maintained inside the hermetic envelope by the adsorbing action of the getter film.

The basic construction and method of manufacturing the display panel of this embodiment will now be described.

The method of manufacturing the multiple electron beam source used in the display panel of the foregoing embodiment will be described next. If the multiple electron beam source used in the image display apparatus of this invention is an electron source obtained by wiring surface-conduction electron emission elements in the form of a simple matrix, there is no limitation upon the material, shape or method of manufacture of the surface-conduction electron emission elements. However, the inventors have discovered that, among the surface-conduction electron emission elements available, an element in which the electron emission portion or periphery thereof is formed from a film of finely divided particles excels in its electron emission characteristic, and that the element can be manufactured easily. Accordingly, it may be construed that such an element is most preferred for used in a multiple electron beam source in an image display apparatus having a high luminance and a large display screen. Accordingly, in the display panel of the foregoing embodiment, use was made of a surface-conduction electron emission element in which the electron emission portion or periphery thereof was formed from a film of finely divided particles. First, therefore, the basic construction, method of manufacture and characteristics of an ideal surface-conduction electron emission element will be described, and this will be followed by a description of the structure of a multiple electron beam source in which a large number of elements are wired in the form of a simple matrix.

Element Construction Ideal for Surface-Conduction Electron Emission Elements, and Method of a Manufacturing Same A planar-type and vertical-type element are the two typical types of construction of surface-conduction electron emission elements available as surface-conduction electron emission elements in which the electron emission portion or periphery thereof is formed from a film of finely divided particles.

Planar-Type Surface-Conduction Electron Emission Element

Figure 6A:
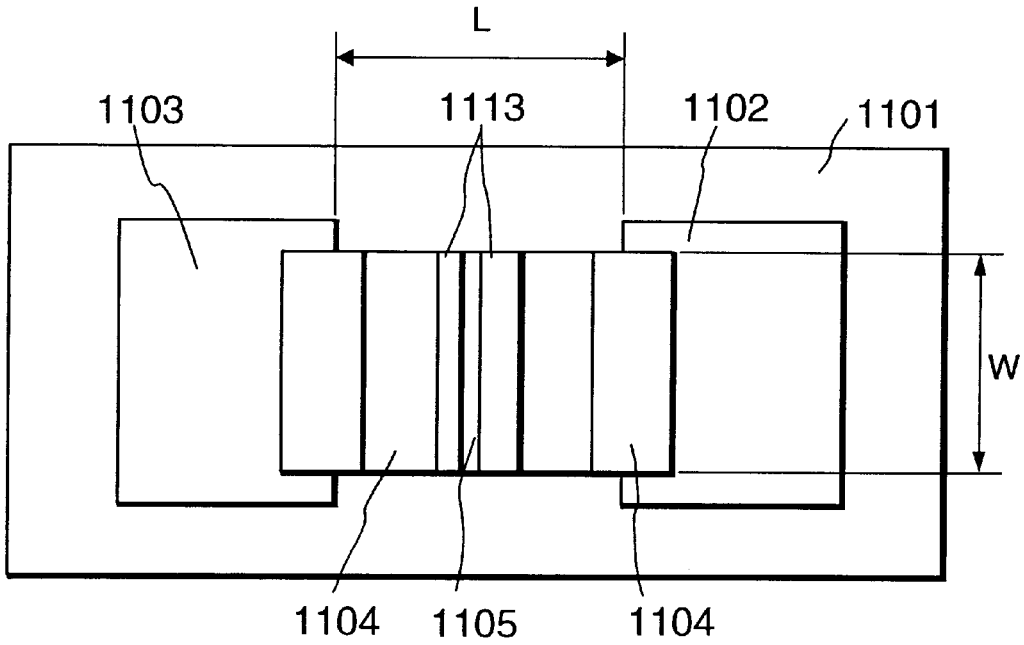
FIGS. 6A and 6B are plan and sectional views, respectively, of a planar-type surface-conduction electron emission element used in this embodiment.
Figure 6B:
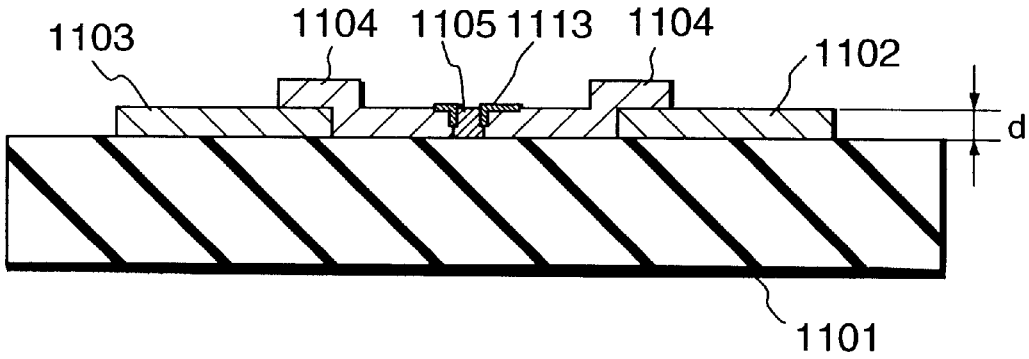

The element construction and manufacture of a planar-type surface-conduction electron emission element will be described first. FIGS. 6A and 6B are plan and sectional views, respectively, for describing the construction of a planar-type surface-conduction electron emission element.

Shown in FIGS. 6A and 6B are a substrate 1101, element electrodes 1102, 1103, an electrically conductive thin film 1104, an electron emission portion 1105 formed by an electrification forming treatment, and a thin film 1113 formed by an electrification activation treatment.

Examples of the substrate 1101 are various glass substrates such as quartz glass and blue glass, various substrates of a ceramic such as alumina, or a substrate obtained by depositing an insulating layer such as $SiO_2$ on the various substrates mentioned above.

The element electrodes 1102, 1103, which are provided so as to oppose each other on the substrate 1101 substantially in parallel with the substrate surface, are formed from a material exhibiting electrical conductivity. Examples of the material that can be mentioned are the metals Ni, Cr, Au, Mo, W, Pt, Ti, Al, Cu, Pd and Ag or alloys of these metals, metal oxides such as $In_2O_3$-$SnO_2$ and semiconductor materials such as polysilicon. If a film manufacturing technique such as vacuum deposition and a patterning technique such as photolithography or etching are used in combination in order to form the electrodes, the electrode can be formed with ease. However, it is permissible to form the electrodes using another method (such as a printing technique).

The shapes of the element electrodes 1102, 1103 are decided in conformity with the application and purpose of the electron emission element. In general, the spacing L between the electrodes may be a suitable value selected from a range of several hundred Ångströms to several hundred microns. Preferably, the range is on the order of several microns to tens of microns in order for the device to be used in a display apparatus. With regard to the thickness d of the element electrodes, a suitable numerical value is selected from a range of several hundred Ångströms to several microns.

A film of finely divided particles is used at the portion of the electrically conductive thin film 1104. The film of finely divided particles mentioned here signifies a film (inclusive of island-shaped aggregates) containing a large number of finely divided particles as structural elements. If a film of finely divided particles is examined microscopically, usually the structure observed is one in which individual fine particles are arranged in spaced-apart relation, one in which the particles are adjacent to one another and one in which the particles overlap one another.

The particle diameter of the finely divided particles used in the film of finely divided particles falls within a range of from several Ångströms to several thousand Ångströms, with the particularly preferred range being 10 to 200 Å. The film thickness of the film of finely divided particles is suitably selected upon taking into consideration the following conditions: conditions necessary for achieving a good electrical connection between the element electrodes 1102 and 1103, conditions necessary for carrying out electrification forming, described later, and conditions necessary for obtaining a suitable value, described later, for the electrical resistance of the film of finely divided particles per se.

More specifically, the film thickness is selected in the range of from several Ångströms to several thousand Ångstr öms, preferably 10 to 500 Å.

Examples of the material used to form the film of finely divided particles are the metals Pd, Pt, Ru, Ag, Au, Ti, In, Cu, Cr, Fe, Zn, Sn, Ta, W and Pb, etc., the oxides PdO, $SnO_2$, $In_2O_3$, PbO and $Sb_2O_3$, etc., the borides $HfB_2$, $ZrM_2$, $LaB_6$, $CeB_6$, YB4 and GdB4,. the carbides TiC, ZrC, HfC, TaC,. SiC and WC, etc., the nitrides TiN, ZrN and HfN, etc., the semiconductors Si, Ge, etc., and carbon. The material may be selected appropriately from these.

As mentioned above, the electrically conductive thin film 1104 is formed from a film of finely divided particles. The sheet resistance is set so as to fall within the range of from $10^3$ to $10^7$ $\Omega/\pi$.

Since it is preferred that the electrically conductive thin film 1104 come into good electrical contact with the element electrodes 1102, 1103 when connected thereto, the adopted structure is such that the film and the element electrodes partially overlap each other. As for the methods of achieving this overlap, one method is to build up the device from the bottom in the order of the substrate, element electrodes and electrically conductive film, as shown in the example of FIGS. 6A and 6B. Depending upon the case, the device may be built up from the bottom in the order of the substrate, electrically conductive film and element electrodes.

The electron emission portion 1105 is a crack-shaped portion formed in part of the electrically conductive thin film 1104 and, electrically speaking, has a resistance higher than that of the surrounding conductive thin film. The crack is formed by subjecting the electrically conductive thin film 1104 to an electrification forming treatment, described later. There are cases in which finely divided particles having a particle diameter of several Ångströms to several hundred Ångströms are placed inside the crack. It should be noted that since it is difficult to illustrate, finely and accurately, the actual position and shape of the electron emission portion, only a schematic illustration is given in FIGS. 6A and 6B.

The thin film 1113 comprises carbon or a carbon compound and covers the electron emission portion 1105 and its vicinity. The thin film 1113 is formed by carrying out an electrification activation treatment, described later, after the electrification forming treatment.

The thin film 1113 is one or a mixture of single-crystal graphite, polycrystalline graphite or amorphous carbon. The film thickness preferably is less than 500 Å, especially less than 300 Å.

It should be noted that since it is difficult to precisely illustrate the actual position and shape of the thin film 1113, only a schematic illustration is given in FIGS. 6A, 6B. Further, in the plan view of FIG. 6A, the element is shown with part of the thin film 1113 removed.

The desired basic construction of the element has been described. The element set forth below was used in this embodiment.

Blue glass was used as the substrate 1101, and a thin film of Ni was used as the element electrodes 1102, 1103. The thickness d of the element electrodes was 1000 A, and the electrode spacing L was 2 $\mu$m. Pd or PdO was used as the main ingredient of the film of finely divided particles, the thickness of the film of finely divided particles was about 100 Å, and the width W was 100 $\mu$m.

The method of manufacturing the preferred planar-type of surface-conduction electron emission element will now be described.

FIGS. 7A~7E are sectional views for describing the process steps for manufacturing the surface-conduction electron emission element. Portions similar to those in FIG. 6A, 6B are designated by like reference numerals.

Figure 7A:
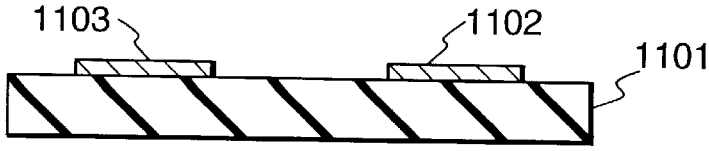
FIGS. 7A~7E are sectional views useful in describing a process for manufacturing a planar-type surface-conduction electron emission element.

1) First, the element electrodes 1102, 1103 are formed on the substrate 1101, as shown in FIG. 7A.

With regard to formation, the substrate 1101 is cleansed sufficiently in advance using a detergent, pure water or an organic solvent, after which the element electrode material is deposited. (An example of the deposition method used is a vacuum film-forming technique such as vapor deposition or sputtering.) Thereafter, the deposited electrode material is patterned using photolithography to form the pair of electrodes 1102, 1103 shown in FIG. 7A.

Figure 7B:
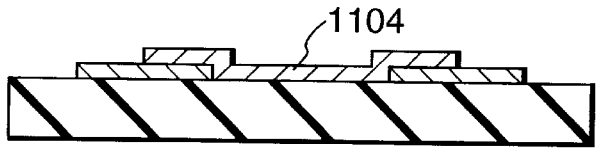

2) Next, the electrically conductive thin film 1104 is formed, as shown in FIG. 7B.

With regard to formation, the substrate of FIG. 7A is coated with an organic metal solution, the latter is allowed to dry, and heating and calcination treatments are applied to form a film of finely divided particles. Patterning is then carried out by photolithographic etching to obtain a prescribed shape. The organic metal solution is a solution of an organic metal compound in which the main element is the material of the finely divided particles used in the electrically conductive film. (Specifically, Pd was used as the main element in this embodiment. Further, the dipping method was employed as the method of application in this embodiment. However, other methods which may be used are the spinner method and spray method.)

Further, besides the method of applying the organic metal solution used in this embodiment as the method of forming the electrically conductive thin film made of the film of finely divided particles, there are cases in which use is made of vacuum deposition and sputtering or chemical vapor deposition.

Figure 7C:
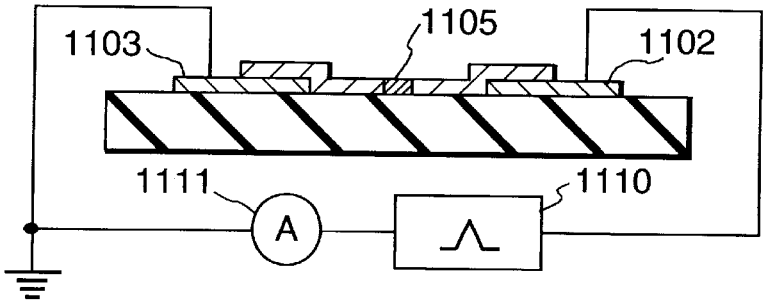

3) Next, as shown in FIG. 7C, a suitable voltage is applied across the element electrodes 1102 and 1103 from a forming power supply 1110, whereby an electrification forming treatment is carried out to form the electron emission portion 1105.

The electrification forming treatment includes passing a current through the electrically conductive thin film 1104, which is made from the film of finely divided particles, to locally destroy, deform or change the property of this portion, thereby obtaining a structure ideal for performing electron emission. At the portion of the electrically conductive film, made of the film of finely divided particles, changed to a structure ideal for electron emission (i.e., the electron emission portion 1105), a crack suitable for a thin film is formed. When a comparison is made with the situation prior to formation of the electron emission portion 1105, it is seen that the electrical resistance measured between the element electrodes 1102 and 1103 after formation has increased to a major degree.

Figure 8:
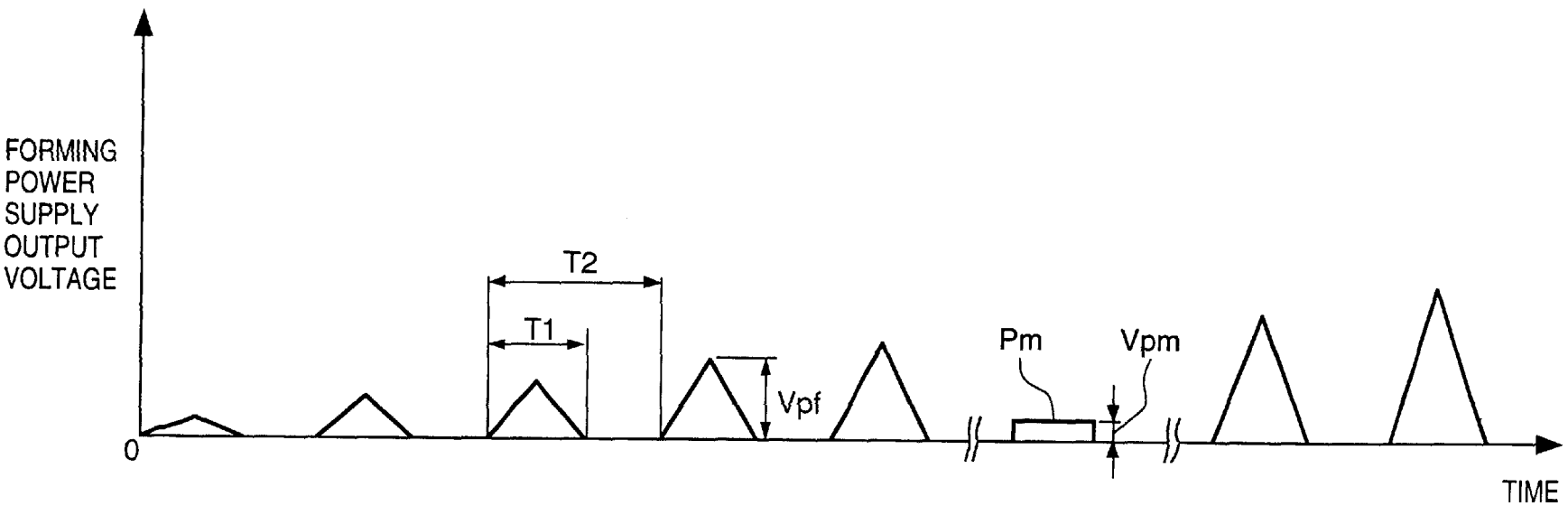
FIG. 8 is a diagram showing an example of a voltage waveform applied when electrification forming is carried out.

In order to give a more detailed description of the electrification method, an example of a suitable voltage waveform supplied from the forming power supply 1110 is shown in FIG. 8. In a case where the electrically conductive film made of the film of finely divided particles is subjected to forming, a pulsed voltage is preferred. In the case of this embodiment, triangular pulses having a pulse width T1 were applied consecutively at a pulse interval T2, as illustrated in the Figure. At this time, the peak value Vpf of the triangular pulses was gradually increased. A monitoring pulse Pm for monitoring the formation of the electron emission portion 1105 was inserted between the triangular pulses at a suitable spacing and the current which flows at such time was measured by an ammeter 1111.

In this embodiment, under a vacuum of, say, $1\times10^{-5}$ torr, the pulse width T1 and pulse interval T2 were made 1 ms and 10 ms, respectively, and the peak voltage Vpf was elevated at increments of 0.1 V every pulse. The monitoring pulse Pm was inserted at a rate of once per five of the triangular pulses. The voltage Vpm of the monitoring pulses was set to 0.1 V so that the forming treatment would not be adversely affected. Electrification applied for the forming treatment was terminated at the stage where the resistance between the terminal electrodes 1102, 1103 became $1\times10^{6}$ Ω, namely at the stage where the current measured by the ammeter 1111 at application of the monitoring pulse fell below $1\times10^{7}$Å.

The method described above is preferred in relation to the surface-conduction electron emission element of this embodiment. In a case where the material or film thickness of the film consisting of the finely divided particles or the design of the surface-conduction electron emission element such as the element-electrode spacing L is changed, it is desired that the conditions of electrification be altered accordingly.

Figure 7D:
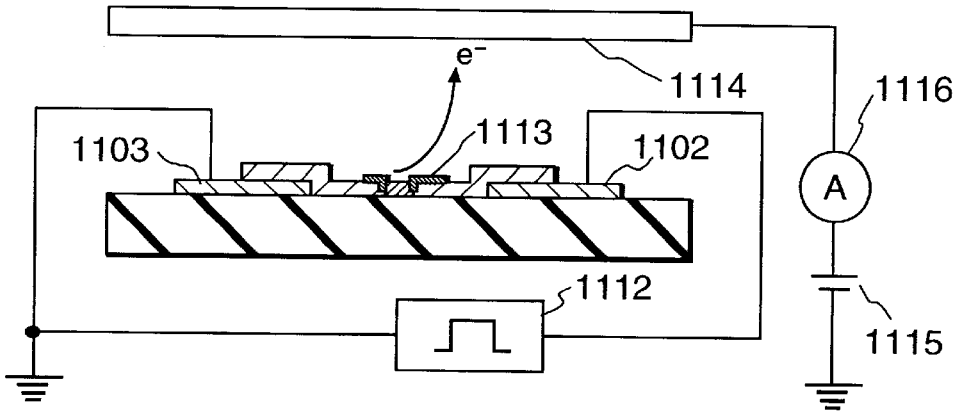

4) Next, as shown in FIG. 7D, a suitable voltage from an activating power supply 1112 was impressed across the element electrodes 1102, 1103 to apply an electrification activation treatment, thereby improving the electron emission characteristic.

This electrification activation treatment involves subjecting the electron emission portion 1105, which has been formed by the above-described electrification forming treatment, to electrification under suitable conditions and depositing carbon or a carbon compound in the vicinity of this portion. (In FIG. 7D, the deposit consisting of carbon or carbon compound is illustrated schematically as a member 1113.) By carrying out this electrification activation treatment, the emission current typically can be increased by more than 100 times, at the same applied voltage, in comparison with the current before application of the treatment.

More specifically, by periodically applying voltage pulses in a vacuum ranging from $1\times10^{-4}$ to $1\times10^{-5}$ torr, carbon or a carbon compound in which an organic compound present in the vacuum serves as the source is deposited. The deposit 1113 is one or a mixture of single-crystal graphite, polycrystalline graphite or amorphous carbon. The film thickness is less than 500 Å, preferably less than 300 Å.

Figure 9A:
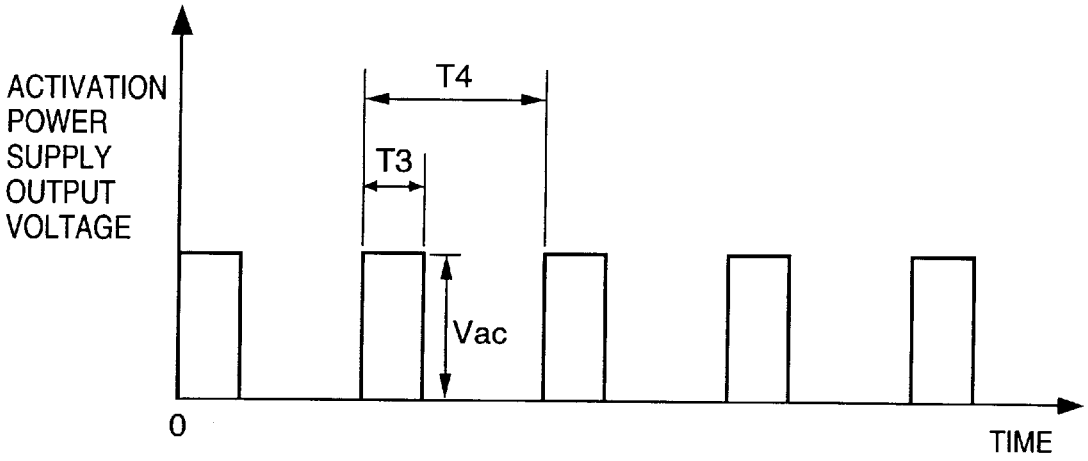
FIG. 9A is a diagram showing a voltage waveform applied when an electrification activation treatment is performed.

In order to give a more detailed description of the electrification method, an example of a suitable waveform supplied by the activation power supply 1112 is illustrated in FIG. 9A. In this embodiment, the electrification activation treatment was conducted by periodically applying rectangular waves of a fixed voltage. More specifically, the voltage Vac of the rectangular waves was made 14 V, the pulse width T3 was made 1 ms, and the pulse interval T4 was made 10 ms. The electrification conditions for activation mentioned above are desirable conditions in relation to the surface-conduction electron emission element of this embodiment. In a case where the design of the surface-conduction electron emission element is changed, it is desired that the conditions be changed accordingly.

Figure 9B:
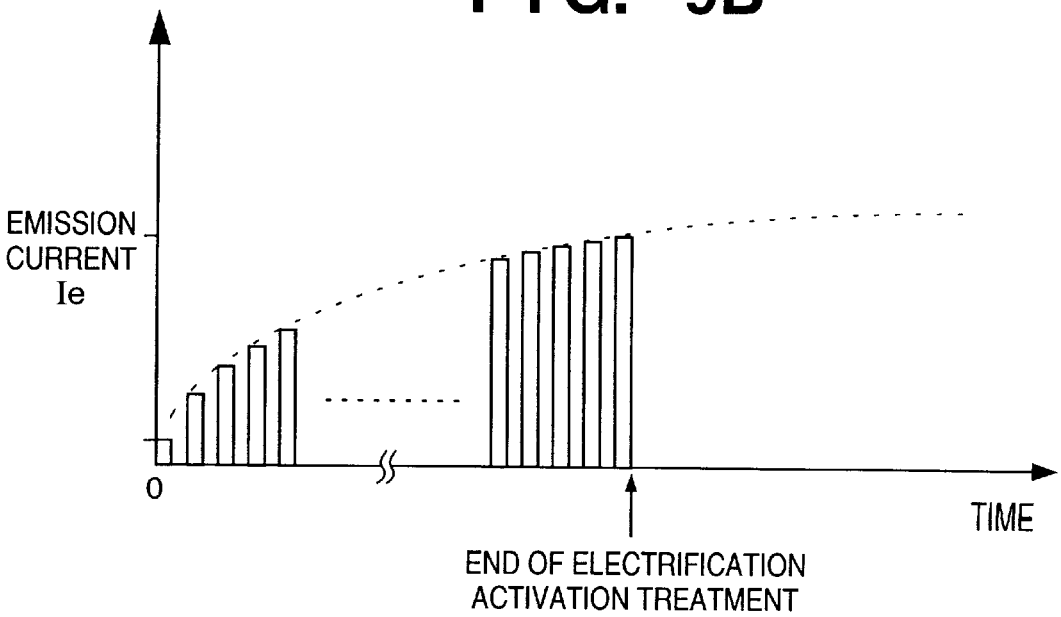
FIG. 9B shows a change in emission current Ie.

Numeral 1114 in FIG. 7D denotes an anode electrode for capturing the emission current Ie obtained from the surface-conduction electron emission element. The anode electrode is connected to a DC high-voltage power supply 1115 and to an ammeter 1116. (In a case where the activation treatment is carried out after the substrate 1101 is installed in the display panel, the phosphor surface of the display panel is used as the anode electrode 1114.) During the time that the voltage is being supplied from the activation power supply 1112, the emission current Ie is measured by the ammeter 1116 to monitor the progress of the electrification activation treatment, and the operation of the activation power supply 1112 is controlled. FIG. 9B illustrates an example of the emission current Ie measured by the ammeter 1116. When the pulsed voltage starts being supplied by the activation power supply 1112, the emission current Ie increases with the passage of time but eventually saturates and then almost stops increasing. At the moment the emission current Ie thus substantially saturates, the application of voltage from the activation power supply 1112 is halted and the activation treatment by electrification is terminated.

It should be noted that the above-mentioned electrification conditions are preferred conditions in relation to the surface-conduction electron emission element of this embodiment. In a case where the design of the surface-conduction electron emission element is changed, it is desired that the conditions be changed accordingly.

Figure 7E:
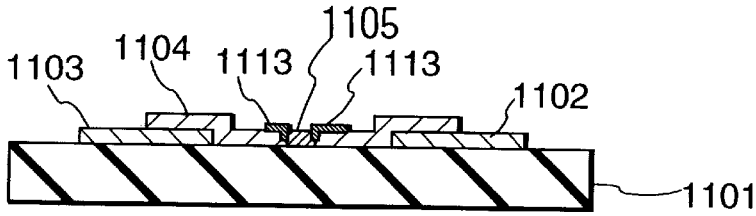

Thus, the planar-type surface-conduction electron emission element shown in FIG. 7E is manufactured as set forth above.

Vertical-Type Surface-Conduction Electron Emission Element

Next, one more typical construction of a surface-conduction electron emission element in which the electron emission portion or its periphery is formed from a film of finely divided particles, namely the construction of a vertical-type surface-conduction electron emission element, will be described.

Figure 10:
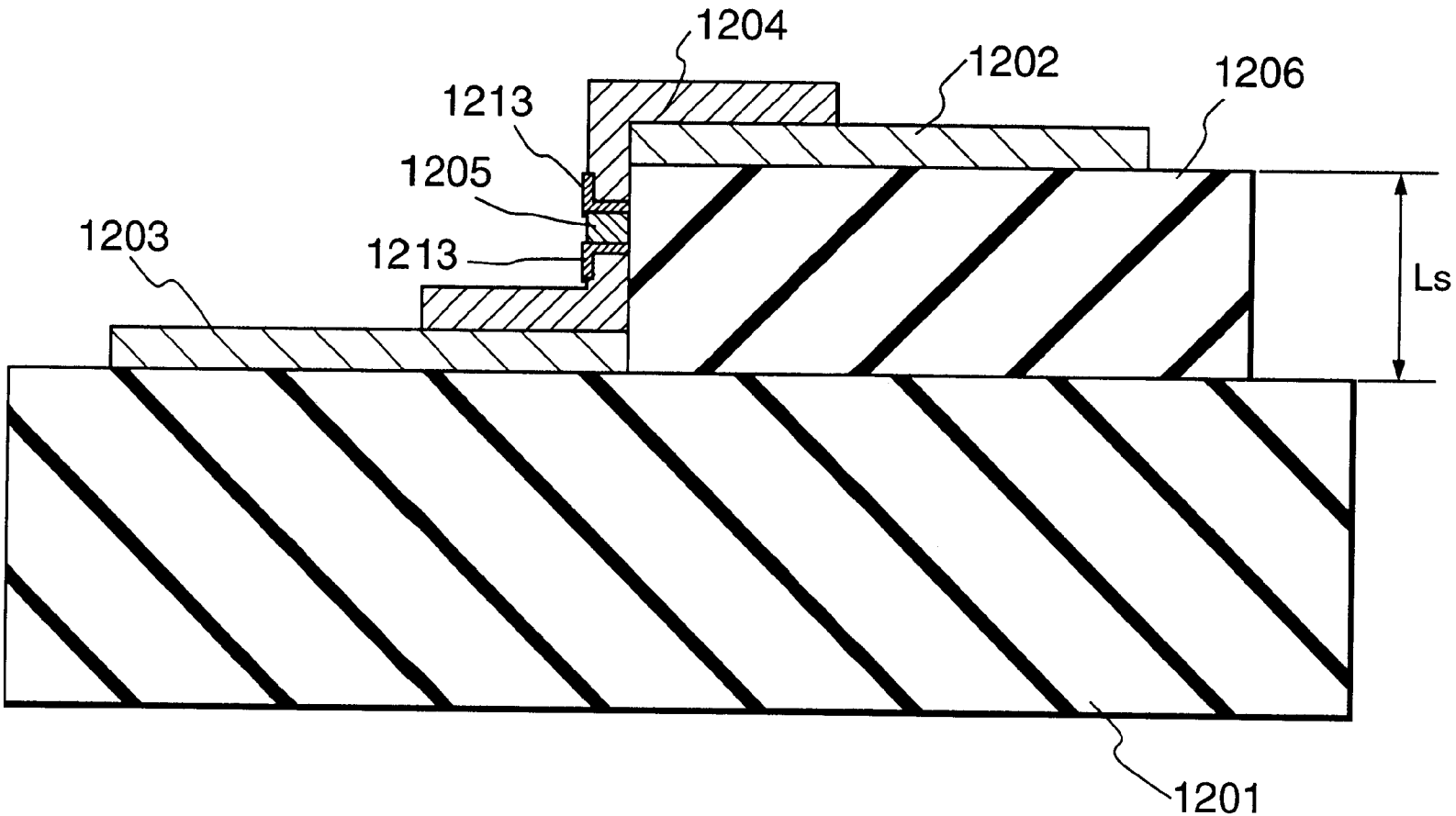
FIG. 10 is a schematic sectional view useful in describing the basic construction of a vertical-type surface-conduction electron emission element.

FIG. 10 is a schematic sectional view for describing the basic construction of the vertical-type element. Numeral 1201 denotes a substrate, 1202 and 1203 element electrodes, 1206 a step forming member, 1204 an electrically conductive thin film using a film of finely divided particles, 1205 an electron emission portion formed by an electrification forming treatment, and 1213 a thin film formed by an electrification activation treatment.

The vertical-type element differs from the planar-type element in that one element electrode (1202) is provided on the step forming member 1206, and in that the electrically conductive thin film 1204 covers the side of the step forming member 1206. Accordingly, the element-electrode spacing L in the planar-type surface-conduction electron emission element shown in FIG. 6A is set as the height Ls of the step forming member 1206 in the vertical-type element. The substrate 1201, the element electrodes 1202, 1203 and the electrically conductive thin film 1204 using the film of finely divided particles can consist of the same materials mentioned in the description of planar-type element. An electrically insulating material such as $SiO_2$ is used as the step forming member 1206.

A method of manufacturing the vertical-type surface-conduction electron emission element will now be described. FIGS. 11A~11F are sectional views for describing the manufacturing steps. The reference characters of the various members are the same as those in FIG. 10.

Figure 11A:
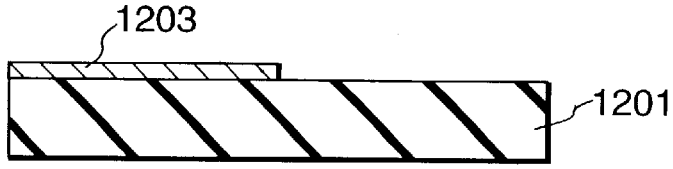
FIGS. 11A~11F are sectional views useful in describing a process for manufacturing a vertical-type surface-conduction electron emission element used in this embodiment.
Figure 11B:
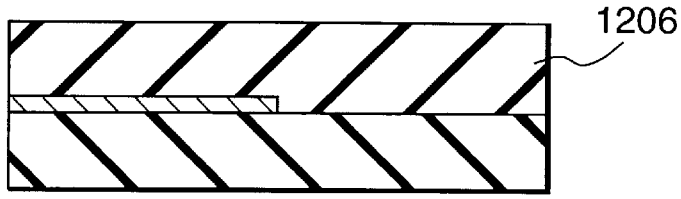
Figure 11C:
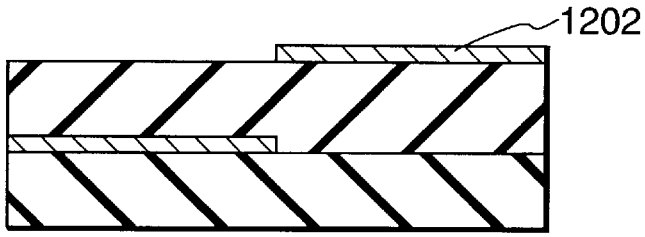
Figure 11D:
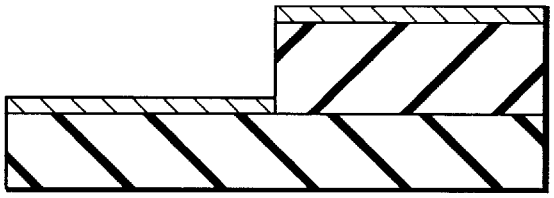
Figure 11E:
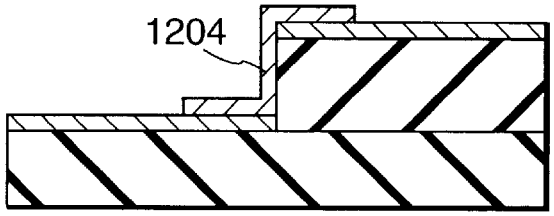

1) First, the element electrode 1203 is formed on the substrate 1201, as shown in FIG. 11A.
2) Next, an insulating layer 1206 for forming the step forming member is built up, as shown in FIG. 11B. It will suffice if this insulating layer 1206 is formed by building up $SiO_2$ using the sputtering method. However, other film forming methods may be used, such as vacuum deposition or printing, by way of example.
3) Next, the element electrode 1202 is formed on the insulating layer 1206, as shown in FIG. 11C.
4) Next, part of the insulating layer 1206 is removed as by an etching process, thereby exposing the element electrode 1203, as shown in FIG. 11D.
5) Next, the electrically conductive thin film 1204 using the film of finely divided particles is formed, as shown in FIG. 11E. In order to form the electrically conductive thin film, it will suffice to use a film forming technique such as painting in the same manner as in the case of the planar-type element.
6) Next, an electrification forming treatment is carried out in the same manner as in the case of the planar-type element, thereby forming the electron emission portion. (It will suffice to carry out a treatment similar to the planar-type electrification forming treatment described using FIG. 7C.)
7) Next, as in the case of the planar-type element, the electrification activation treatment is performed to deposit carbon or a carbon compound in the vicinity of the electron emission portion. (It will suffice to carry out a treatment similar to the planar-type electrification activation treatment described using FIG. 7D.)

Figure 11F:
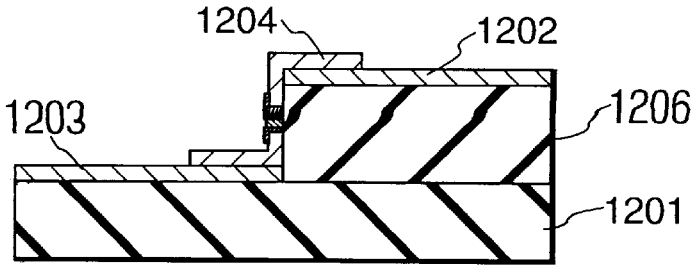

Thus, the vertical-type surface-conduction electron emission element shown in FIG. 11F is manufactured as set forth above.

Characteristics of Surface-Conduction Electron Emission Element Used in Display Apparatus The element construction and method of manufacturing the planar- and vertical-type surface-conduction electron emission elements have been described above. The characteristics of these elements used in a display apparatus will now be described.

Figure 12:
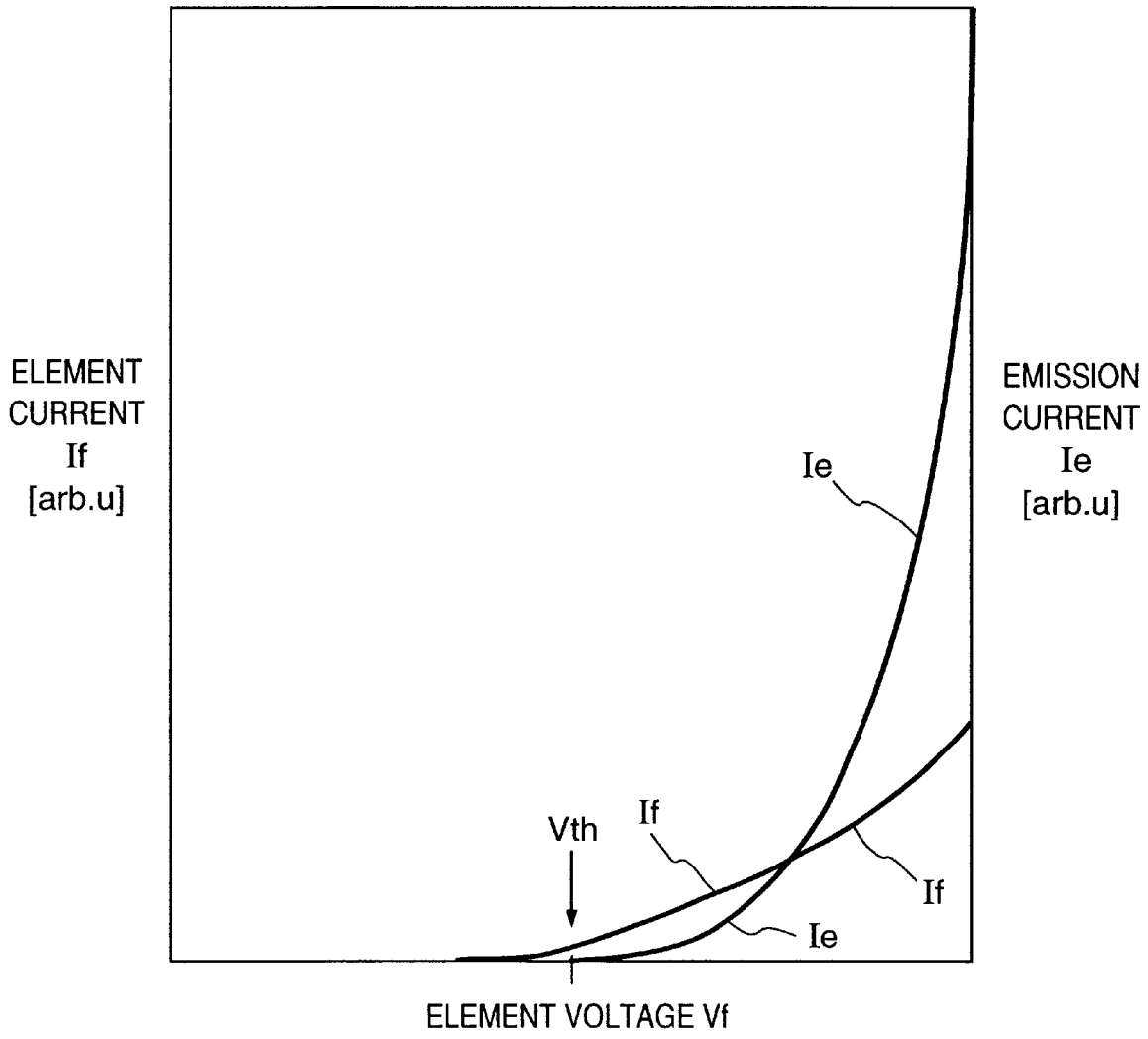
FIG. 12 is a graph showing a typical characteristic of the surface-conduction electron emission element used in this embodiment.

FIG. 12 illustrates a typical example of an (emission current Ie) vs. (applied element voltage Vf) characteristic and of an (element current If) vs. (applied element voltage Vf) characteristic of the elements used in a display apparatus. It should be noted that the emission current Ie is so much smaller than the element current If that it is difficult to use the same scale to illustrate it. Moreover, these characteristics are changed by changing the design parameters such as the size and shape of the elements. Accordingly, the two curves in the graph are each illustrated using arbitrary units.

The elements used in this display apparatus have the following three characteristics in relation to the emission current Ie:

First, when a voltage greater than a certain voltage (referred to as a threshold voltage Vth) is applied to the element, the emission current Ie suddenly increases. When the applied voltage is less than the threshold voltage Vth, on the other hand, almost no emission current Ie is detected. In other words, the element is a non-linear element having the clearly defined threshold voltage Vth with respect to the emission current Ie.

Second, since the emission current Ie varies in dependence upon the voltage Vf applied to the element, the magnitude of the emission current Ie can be controlled by the voltage Vf.

Third, since the response speed of the current Ie emitted from the element is high in response to a change in the voltage Vf applied to the element, the amount of charge of the electron beam emitted from the element can be controlled by the length of time over which the voltage Vf is applied.

Because they possess the foregoing characteristics, surface-conduction electron emission elements are ideal for use in a display apparatus. For example, in a display apparatus in which a number of elements are provided to correspond to pixels of a displayed image, the display screen can be scanned sequentially to present a display if the first characteristic mentioned above is utilized. More specifically, a voltage greater than the threshold voltage Vth is suitably applied to driven elements in conformity with a desired light-emission luminance, and a voltage less than the threshold voltage Vth is applied to elements that are in an unselected state. By sequentially switching over elements driven, the display screen can be scanned sequentially to present a display.

Further, by utilizing the second characteristic or third characteristic, the luminance of the emitted light can be controlled. This makes it possible to present a grayscale display.

Structure of Multiple Electron Beam Source Having Number of Elements Wired in Form of Simple Matrix Described next will be the structure of a multiple electron beam source obtained by arraying the aforesaid surface-conduction electron emission elements on a substrate and wiring the elements in the form of a simple matrix.

Figure 13:
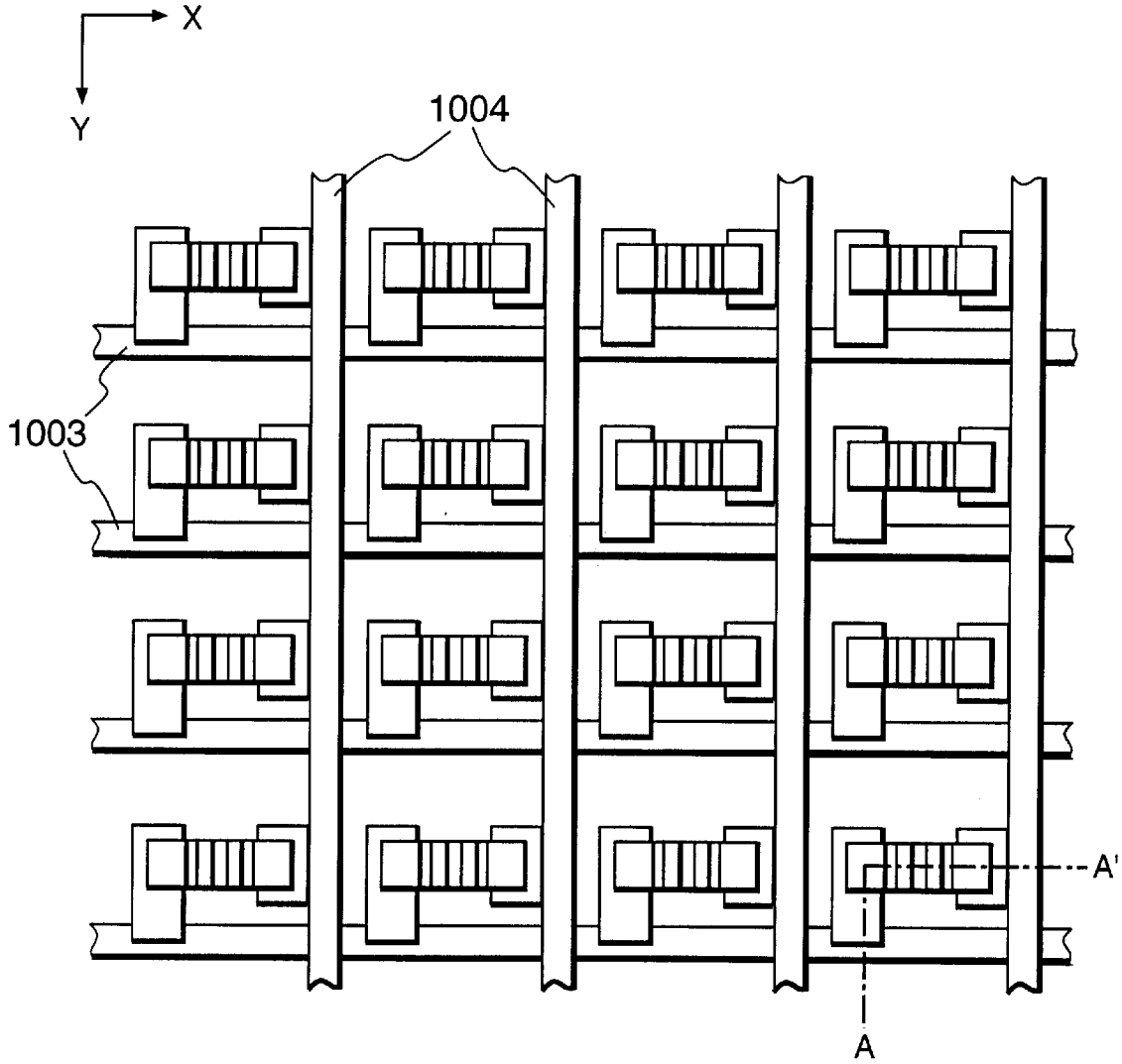
FIG. 13 is a plan view showing the substrate of a multiple electron beam source used in this embodiment.

FIG. 13 is a plan view of a multiple electron beam source used in the display panel of FIG. 4. Here surface-conduction electron emission elements similar to the type shown in FIG. 6A are arrayed on the substrate and these elements are wired in the form of a simple matrix by the row-direction wiring electrodes 1003 and column-direction wiring electrodes 1004. An insulating layer (not shown) is formed between the electrodes at the portions where the row-direction wiring electrodes 1003 and column-direction wiring electrodes 1004 intersect, thereby maintaining electrical insulation between the electrodes.

Figure 14:
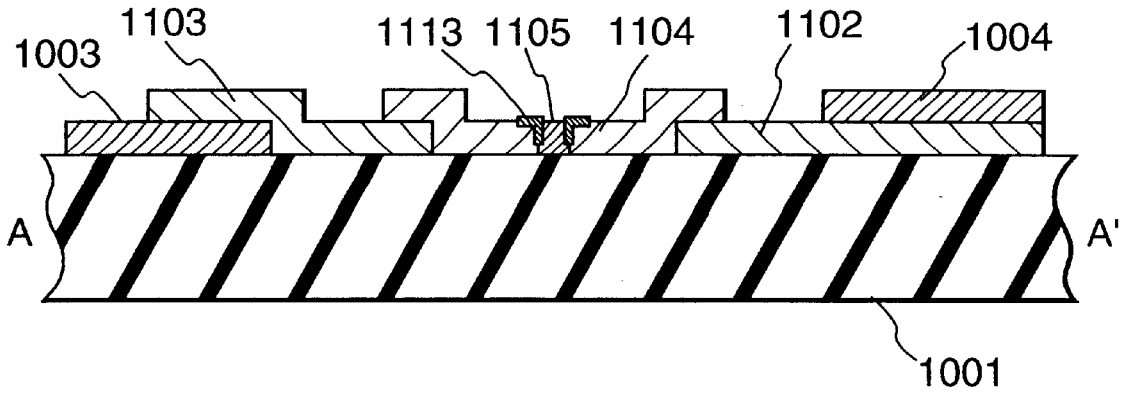
FIG. 14 is a sectional view of part of the substrate of the surface-conduction electron emission element used in this embodiment.
Figure 16:
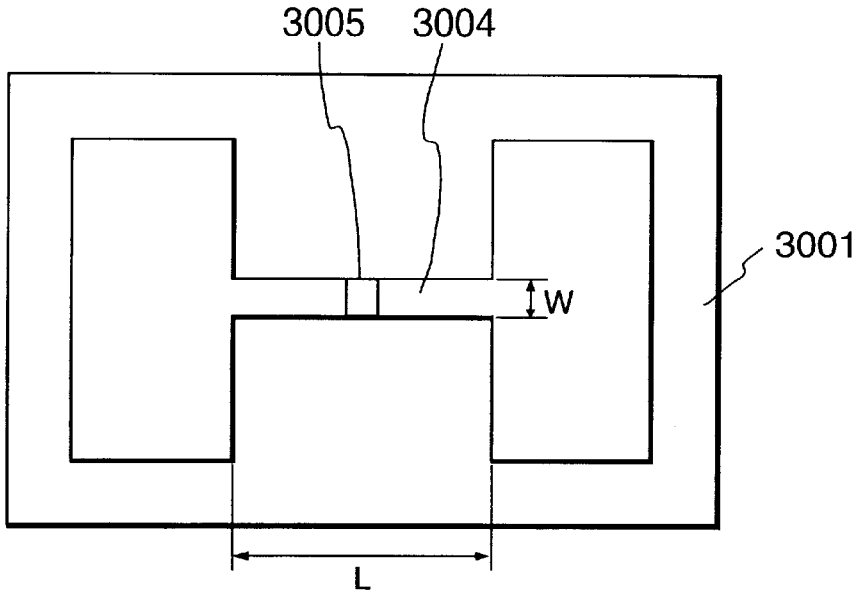
FIG. 16 is a diagram showing an example of a surface-conduction electron emission element according to the prior art.
Figure 17:
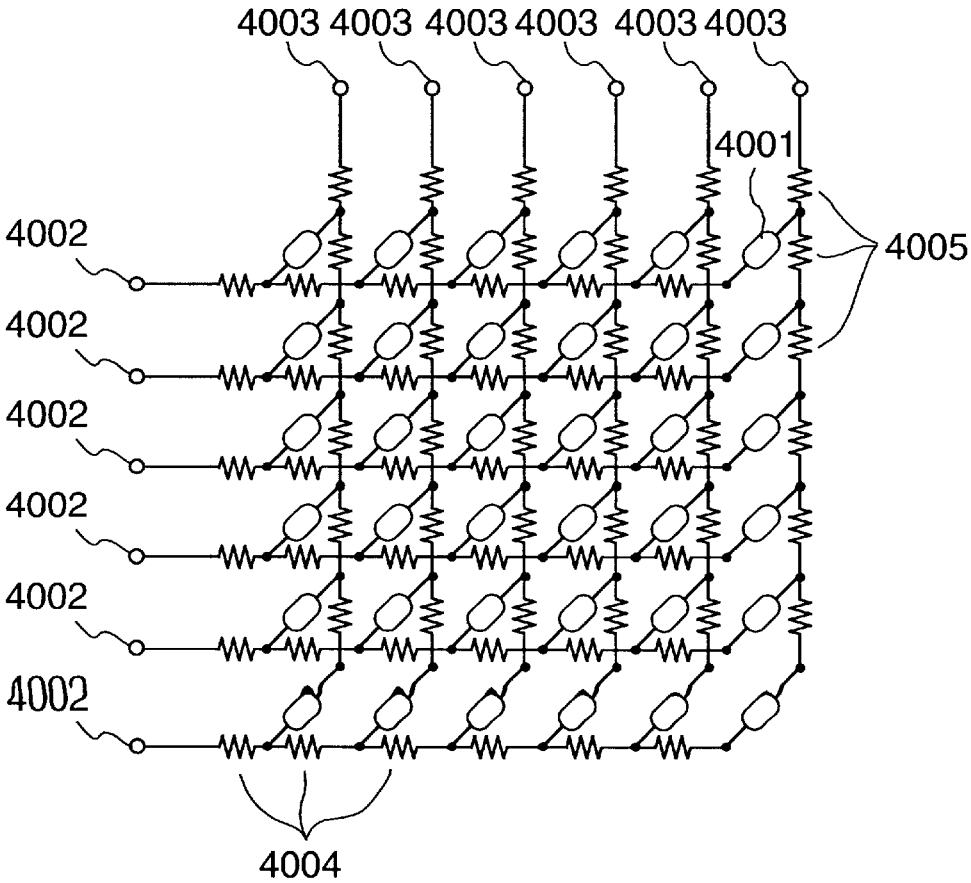
FIG. 17 is a diagram useful in describing a method of wiring an electron emission element attempted by the inventors.
Figure 18:
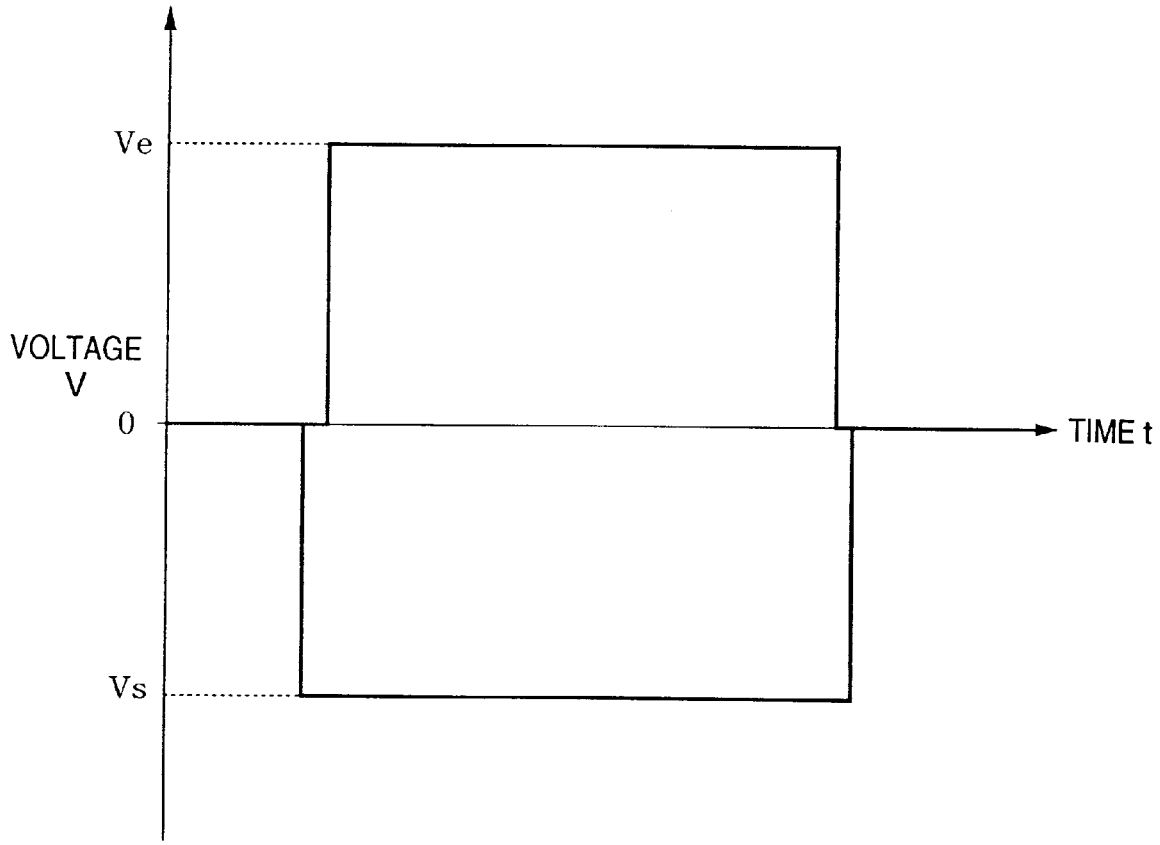
FIG. 18 is a diagram for describing a voltage waveform, which drives an ordinary multiple electron beam source, as well as the timing thereof.
Figure 19A:
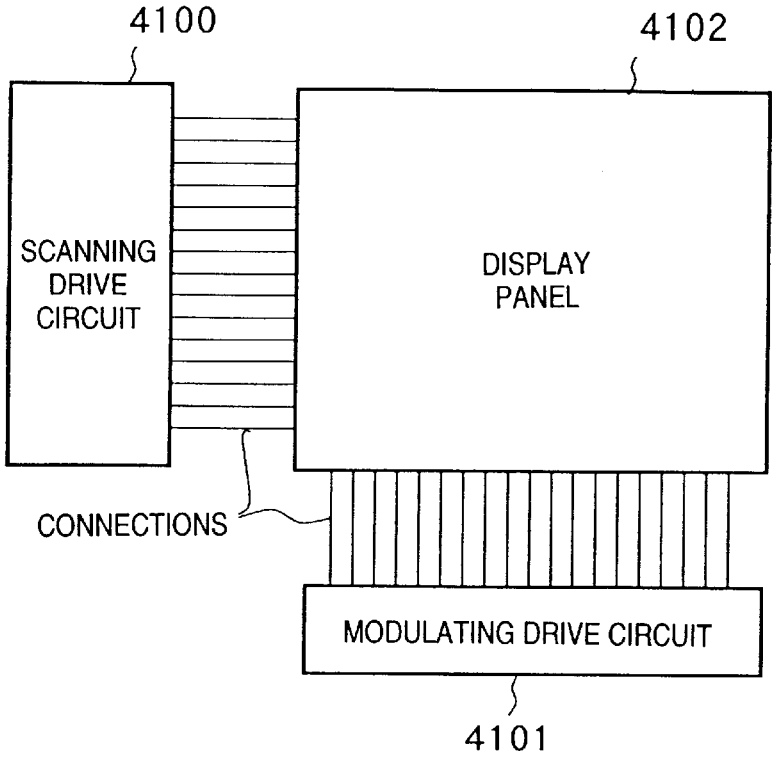
FIG. 19A shows an electron source, its drive circuits and the connections between them.
Figure 19B:
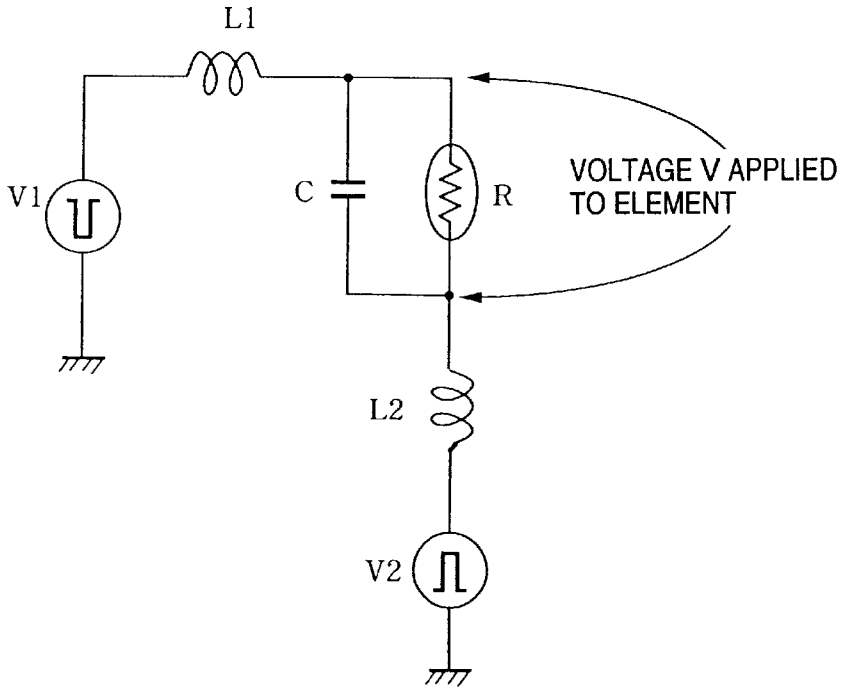
FIG. 19B is an equivalent circuit diagram useful in describing the electrical characteristics of this electron source, its drive circuits and the connections.
Figure 20:
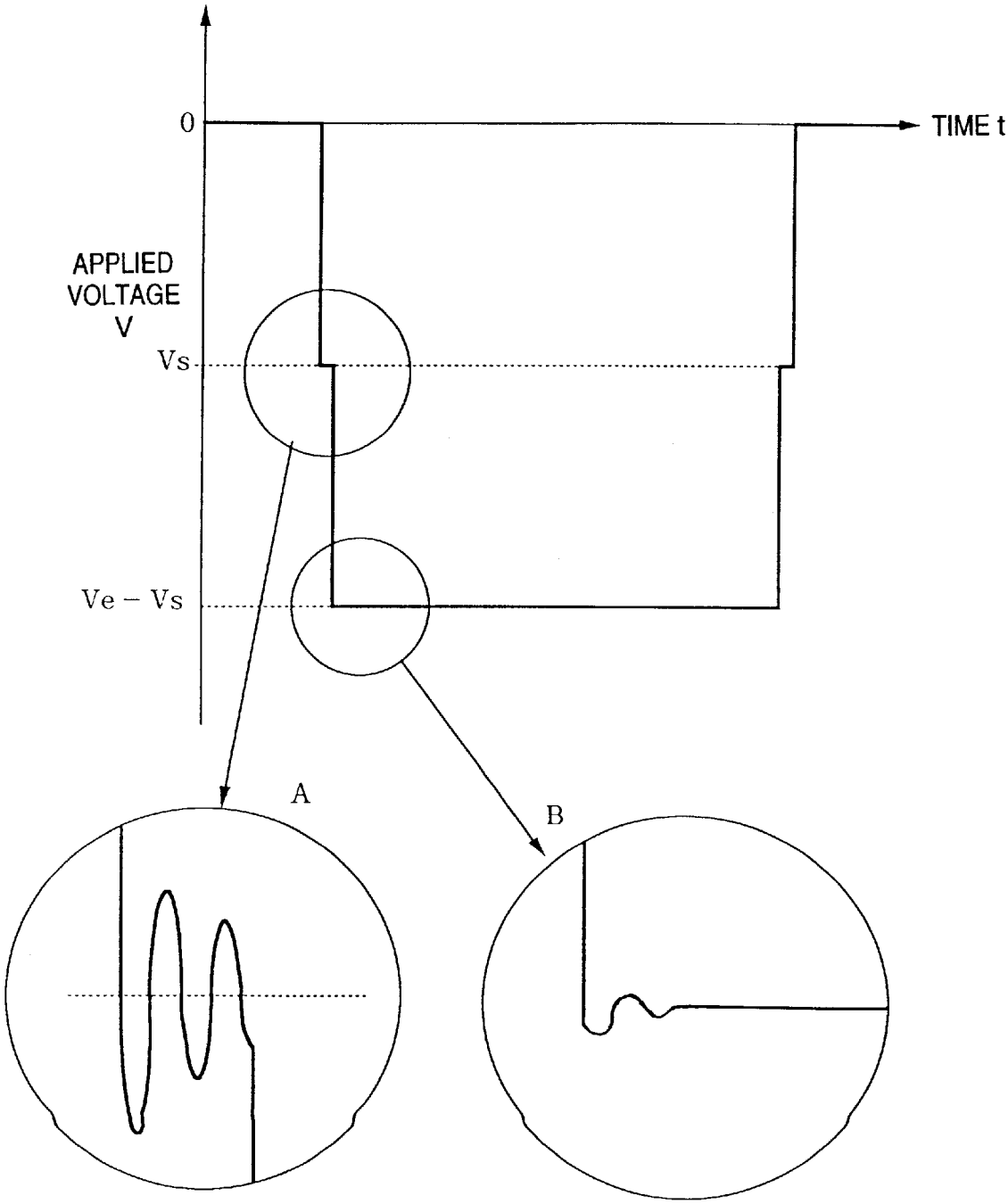
FIG. 20 is a diagram useful in describing a transient signal waveform applied to the electron source.

FIG. 14 is a sectional view taken along lines A—A' of FIG. 13.

It should be noted that the multiple electron source having this structure is manufactured by forming the row-direction wiring electrodes 1003, column-direction wiring electrodes 1004, inter-electrode insulating layer (not shown) and the element electrodes and electrically conductive thin film of the surface-conduction electron emission elements on the substrate in advance, and then applying the electrification forming treatment and electrification activation treatment by supplying current to each element via the row-direction wiring electrodes 1003 and column-direction wiring electrodes 1004.

Example of Application to Display Panel

FIG. 15 is a diagram showing an example of a multifunction display apparatus constructed in such a manner that image information supplied from various image information sources, the foremost of which is a television broadcast, can be displayed on a display panel in which the surface-conduction electron emission elements described above are used as the electron beam source.

Shown in FIG. 15 are a display panel 2100, a drive circuit 2101 for the display panel, a display controller 2102, a multiplexer 2103, a decoder 2104, an input/output interface circuit 2105, a CPU 2106, an image forming circuit 2107, image-memory interface circuits 2108, 2109 and 2110, an image-input interface circuit 2111, TV-signal receiving circuits 2112, 2113, and an input unit 2114.

In a case where this display apparatus receives a signal containing both video information and audio information as in the manner of a television signal, for example, audio is of course reproduced at the same time that video is displayed. However, circuitry and speakers related to the reception, separation, reproduction, processing and storage of audio information not directly related to the features of this embodiment are not described. The functions of the various units will be described in line with the flow of the image signal.

First, the TV-signal receiving circuit 2113 receives a TV image signal transmitted using a wireless transmission system that relies upon radio waves, optical communication through space, etc. The system of the TV signals received is not particularly limited. Examples of the systems are the NTSC system, PAL system and SECAM system, etc. A TV signal comprising a greater number of scanning lines (e.g., a so-called high-quality TV signal such as one based upon the MUSE system) is a signal source that is ideal for exploiting the advantages of the above-mentioned display panel suited to enlargement of screen area and to an increase in the number of pixels. A TV signal received by the TV-signal receiving circuit 2113 is output to the decoder 2104.

The TV-signal receiving circuit 2112 receives the TV image signal transmitted by a cable transmission system using coaxial cable or optical fibers, etc. As in the case of the TV-signal receiving circuit 2113, the system of the received TV signal is not particularly limited. Further, the TV signal received by this circuit also is output to the decoder 2104.

The image-input interface circuit 2111 is a circuit for accepting an image signal supplied by an image input unit such as a TV camera or image reading scanner. The accepted image signal is output to the decoder 2104.

The image-memory interface circuit 2110 accepts an image signal that has been stored in a video tape recorder (hereinafter abbreviated to VTR) and outputs the accepted image signal to the decoder 2104. The image-memory interface circuit 2109 accepts an image signal that has been stored on a video disk and outputs the accepted image signal to the decoder 2104.

The image-memory interface circuit 2108 accepts an image signal from a device storing still-picture data, such as a so-called still-picture disk, and outputs the accepted still-picture data to the decoder 2104.

The input/output interface circuit 2105 is a circuit for connecting the display apparatus and an external computer, computer network or output device such as a printer. It is of course possible to input/output image data, character data and graphic information and, depending upon the case, it is possible to input/output control signals and numerical data between the CPU 2106, with which the display apparatus is equipped, and an external unit.

The image generating circuit 2107 is for generating display image data based upon image data and character/graphic information entered from the outside via the input/output interface circuit 2105 or based upon image data character/graphic information output by the CPU 2106. By way of example, the circuit is internally provided with a rewritable memory for storing image data or character/graphic information, a read-only memory in which image patterns corresponding to character codes have been stored, and a circuit necessary for generating an image, such as a processor for executing image processing. The display image data generated by the image generating circuit 2107 is output to the decoder 2104. In certain cases, however, it is possible to input/output image data relative to an external computer network or printer via an input/output interface circuit 2105.

The CPU 2106 mainly controls the operation of the display apparatus and operations relating to the generation, selection and editing of display images.

For example, the CPU outputs a control signal to the multiplexer 2103 to suitable select or combine image signals displayed on the display panel. At this time the CPU generates a control signal for the display panel controller 2102 in conformity with the image signal displayed and suitably controls the operation of the display apparatus, such as the frequency of the screen display, the scanning method (interlaced or non-interlaced) and the number of screen scanning lines.

Furthermore, the CPU outputs image data and character/graphic information directly to the image generating circuit 2107 or accesses the external computer or memory via the input/output interface circuit 2105 to enter the image data or character/graphic information.

It goes without saying that the CPU 2106 may also be used for purposes other than these. For example, the CPU may be directly applied to a function for generating and processing information, as in the manner of a personal computer or word processor. Alternatively, the CPU may be connected to an external computer network via the input/output interface circuit 2105, as mentioned above, so as to perform an operation such as numerical computation in cooperation with external equipment.

The input unit 2114 is for allowing the user to enter instructions, programs or data into the CPU 2106. Examples are a keyboard and mouse or various other input devices such as a joystick, bar code reader, audio recognition unit, etc.

The decoder 2104 is a circuit for reversely converting various image signals, which enter from the units

2107~2113, into color signals of the three primary colors or a luminance signal and I, Q signals. It is desired that the decoder 2104 be internally equipped with an image memory, as indicated by the dashed line. This is for the purpose of handling a television signal that requires an image memory when performing the reverse conversion, as in a MUSE system, by way of example. Providing the image memory is advantageous in that display of a still picture is facilitated and in that, in cooperation with the image generating circuit 2107 and CPU 2106, editing and image processing such as thinning out of pixels, interpolation, enlargement, reduction and synthesis are facilitated.

The multiplexer 2103 suitably selects the display image based upon a control signal which enters from the CPU 2106. More specifically, the multiplexer 2103 selects a desired image signal from among the reversely-converted image signals which enter from the decoder 2104 and outputs the selected signal to the drive circuit 2101. In this case, by changing over and selecting the image signals within the display time of one screen, one screen can be divided up into a plurality of areas and images which differ depending upon the area can be displayed as in the manner of a so-called split-screen television.

The display panel controller 2102 is a circuit which controls the operation of the drive circuit 2101 based upon the control signal which enters from the CPU 2106.

With regard to the basic operation of the display panel, a signal for controlling the operating sequence of a driving power supply (not shown) for the display panel is output to the drive circuit 2101, by way of example. In relation to the method of driving the display panel, a signal for controlling, say, the screen display frequency or scanning method (interlaced or non-interlaced) is output to the drive circuit 2101.

Further, there is a case in which a control signal relating to adjustment of picture quality, namely luminance of the display image, contrast, tone and sharpness, is output to the drive circuit 2101.

The drive circuit 2101 is a circuit for generating a drive signal applied to the display panel 2100 and operates based upon the image signal which enters from the multiplexer 2103 and the control signal which enters from the display panel controller 2102.

The functions of the various units are as described above. By using the arrangement shown in FIG. 15, image information which enters from a variety of image information sources can be displayed on the display panel 2100 in the display apparatus of this embodiment. Specifically, various image signals, the foremost of which is a television broadcast signal, are reversely converted in the decoder 2104, suitably selected in the multiplexer 2103 and entered into the drive circuit 2101. On the other hand, the display controller 2102 generates a control signal for controlling the operation of the drive circuit 2101 in dependence upon the image signal displayed. On the basis of the aforesaid image signal and control signal, the drive circuit 2101 applies a driving signal to the display panel 2100. As a result, an image is displayed on the display panel 2100. This series of operations is under the overall control of the CPU 2106.

Further, in the display apparatus of this embodiment, the contribution of the image memory incorporated within the decoder 2104, the image generating circuit 2107 and CPU 2106 make it possible not only to display image information selected from a plurality of items of image information but also to subject the displayed image information to image processing such as enlargement, reduction, rotation, movement, edge emphasis, thinning-out, interpolation, color conversion and vertical-horizontal ratio conversion and to image editing such as synthesis, erasure, connection, substitution and fitting. Further, though not particularly touched upon in the description of this embodiment, it is permissible to provide a special-purpose circuit for performing processing and editing with regard also to audio information in the same manner as the image processing and image editing set forth above.

Accordingly, the display apparatus of this invention is capable of being provided with various functions in a single unit, such as the functions of TV broadcast display equipment, office terminal equipment such as television conference terminal equipment, image editing equipment for handling still pictures and moving pictures, computer terminal equipment and word processors, games, etc. Thus, the display apparatus has wide application for industrial and private use.

FIG. 15 merely shows an example of the construction of a display apparatus using a display panel in which surface-conduction electron emission elements are adopted as the electron beam source. However, it goes without saying that the invention is not limited to this arrangement. For example, circuits relating to functions not necessary for the particular purpose of use may be deleted from the structural elements of FIG. 15. Conversely, depending upon the purpose of use, structural elements may be additionally provided. For example, in a case where the display apparatus is used as a TV telephone, it would be ideal to add a transmitting/receiving circuit inclusive of a television camera, audio microphone, illumination equipment and modem to the structural elements.

In this display apparatus, a display panel in which surface-conduction electron emission elements serve as the electron beam source can be reduced in thickness with ease. This makes it possible to reduce the overall size of the display apparatus in the depth direction. In addition, a display panel in which surface-conduction electron emission elements serve as the electron beam source can readily be enlarged in terms of screen size, and the display panel excels in its high luminance and viewing angle characteristic. This means that it is possible for the display apparatus to display, with excellent visual clarity, an image which is realistic and impressive.

Thus, in accordance with the present invention, as described above, the effects of ringing at application of driving signals is reduced in an effective manner, the driving of elements is stabilized, the electron emission of an electron source, for example, is stabilized and formation of a high-quality image becomes possible. Further, in a case where constant-current supply means is used when a potential is applied, it is possible to relax the requirement for response time for the purpose of maintaining a constant current.

As many apparently widely different embodiments of the present invention can be made without departing from the spirit and scope thereof, it is to be understood that the invention is not limited to the specific embodiments thereof except as defined in the appended claims.

What is claimed is:

1. A drive apparatus for driving an electron emission element driven by two different potentials applied thereto, comprising:

first application means for applying a first potential to the electron emission element;

second application means for applying a second potential to the electron emission element; and delay means for providing a delay time following application of the first potential in order to delay application of the second potential;

said delay time being set to be longer than a time required for a ringing waveform, which is produced by application of the first potential, to be damped to 1%.

2. The apparatus according to claim 1, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

3. The apparatus according to claim 2, wherein said first application means applies the first potential to a plurality of row-direction wires while selecting these row-direction wires sequentially.

4. The apparatus according to claim 2, wherein said second application means applies the second potential based upon an image signal.

5. The apparatus according to claim 1, wherein the first and second potentials are set to values that will not cause the element to be driven when the first potential is being applied and the second potential is not.

6. The apparatus according to claim 1, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

7. A drive apparatus for driving an electron source device obtained by connecting, by wiring, an electron emission element driven by two different potentials applied thereto, comprising:

first application means for applying a first potential to the electron emission element;

second application means for applying a second potential to the electron emission element; and delay means for providing a delay time Td following application of the first potential in order to delay application of the second potential;

said delay time Td satisfying the following inequality when R, C and L represent a resistance value, capacitance component and inductance component of the electron source device, respectively:

$$Td>(0.733/\zeta)\times(2\pi/\omega_0)$$

where $$\zeta=1/(2R)\times\sqrt{(L/C)},\ \omega_0=\sqrt{(L/C)}.$$

8. The apparatus according to claim 7, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

9. The apparatus according to claim 8, wherein said first application means applies the first potential to a plurality of row-direction wires while selecting these row-direction wires sequentially.

10. The apparatus according to claim 8, wherein said second application means applies the second potential based upon an image signal.

11. The apparatus according to claim 7, wherein the first and second potentials are set to values that will not cause the element to be driven when the first potential is being applied and the second potential is not.

12. The apparatus according to claim 7, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

13. A drive apparatus for driving an electron emission element driven by two different potentials applied thereto, comprising:

first application means for applying a first potential to the electron emission element;

second application means for applying a second potential to the electron emission element; and delay means for providing a delay time following application of the first potential in order to delay application of the second potential;

said delay time being set to be longer than a time required for a ringing waveform, which is produced by application of the first potential, to be damped so that when the second potential is applied, the electron emission element will no longer be destroyed by a voltage that is the difference between the two potentials applied to said electron emission element.

14. The apparatus according to claim 13, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

15. The apparatus according to claim 14, wherein said first application means applies the first potential to a plurality of row-direction wires while selecting these row-direction wires sequentially.

16. The apparatus according to claim 14, wherein said second application means applies the second potential based upon an image signal.

17. The apparatus according to claim 13, wherein the first and second potentials are set to values that will not cause the element to be driven when the first potential is being applied and the second potential is not.

18. The apparatus according to claim 13, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

19. A drive apparatus for driving an electron emission element driven by two different potentials applied thereto, comprising:

first application means for applying a first potential to the electron emission element;

second application means for applying a second potential to the electron emission element; and delay means for providing a delay time following application of the first potential in order to delay application of the second potential;

said delay time being set to be longer than a time required for a ringing waveform, which is produced by application of the first potential, to be damped so that when the second potential is applied, a change in a characteristic of the electron emission element caused by a voltage that is the difference between the two potentials applied to said electron emission element will fall within an allowable range.

20. The apparatus according to claim 19, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

21. The apparatus according to claim 20, wherein said first application means applies the first potential to a plurality of row-direction wires while selecting these row-direction wires sequentially.

22. The apparatus according to claim 20, wherein said second application means applies the second potential based upon an image signal.

23. The apparatus according to claim 19, wherein the first and second potentials are set to values that will not cause the element to be driven when the first potential is being applied and the second potential is not.

24. The apparatus according to claim 19, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

25. A drive apparatus for driving an electron emission element driven by two different potentials applied thereto, comprising:

first application means for applying a first potential to the electron emission element;

second application means for applying a second potential to the electron emission element; and delay means for providing a delay time following application of the first potential in order to delay application of the second potential;

said delay time being set to be longer than a time required for a ringing waveform, which is produced by application of the first potential, to be damped so that when the second potential is applied, a change in state of drive of the electron emission element caused by a voltage that is the difference between the two potentials applied to-said electron emission element will fall within an allowable range.

26. The apparatus according to claim 25, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

27. The apparatus according to claim 26, wherein said first application means applies the first potential to a plurality of row-direction wires while selecting these row-direction wires sequentially.

28. The apparatus according to claim 26, wherein said second application means applies the second potential based upon an image signal.

29. The apparatus according to claim 25, wherein the first and second potentials are set to values that will not cause the element to be driven when the first potential is being applied and the second potential is not.

30. The apparatus according to claim 25, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

31. A drive apparatus for driving an element driven by two different potentials applied thereto, said element having a response frequency greater than a ringing frequency of the potentials applied, comprising:

first application means for applying a first potential to the element;

second application means for applying a second potential to the element; and delay means for providing a delay time following application of the first potential in order to delay application of the second potential;

said delay time being set to be longer than a time required for a ringing waveform, which is produced by application of the first potential, to be damped to 1%.

32. The apparatus according to claim 31, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

33. The apparatus according to claim 32, wherein said first application means applies the first potential to a plurality of row-direction wires while selecting these row-direction wires sequentially.

34. The apparatus according to claim 32, wherein said second application means applies the second potential based upon an image signal.

35. The apparatus according to claim 31, wherein the first and second potentials are set to values that will not cause the element to be driven when the first potential is being applied and the second potential is not.

36. The apparatus according to claim 31, wherein said element is driven by a voltage which is a difference between the two different potentials which are applied thereto via two wirings, said first application means applies the first potential to one of the two wirings and said second application means applies the second potential to the other.

37. A drive apparatus for driving an electron source device obtained by connecting, by wiring, an element driven by two different potentials applied thereto, comprising:

first application means for applying a first potential to the element;

second application means for applying a second potential to the element; and delay means for providing a delay time Td following application of the first potential in order to delay application of the second potential;

said delay time Td satisfying the following inequality when R, C and L represent a resistance value, capacitance component and inductance component of the electron source device, respectively:

$$Td>(0.733/\zeta)\times(2\pi/(\omega_0)$$

where $$\zeta=1/(2R)\times\sqrt{(L/C)},\ \omega_0=\sqrt{(L/C)};$$

said element having a response frequency that is greater than $\omega_0$.

38. The apparatus according to claim 37, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

39. The apparatus according to claim 38, wherein said first application means applies the first potential to a plurality of row-direction wires while selecting these row-direction wires sequentially.

40. The apparatus according to claim 38, wherein said second application means applies the second potential based upon an image signal.

41. The apparatus according to claim 37, wherein the first and second potentials are set to values that will not cause the element to be driven when the first potential is being applied and the second potential is not.

42. The apparatus according to claim 37, wherein said element is an electron emission element, said electron emission element is driven by a voltage which is a difference between the two different potentials which are applied thereto via two wirings, said first application means applies the first potential to one of the two wirings and said second application means applies the second potential to the other.

43. A drive apparatus for driving an element driven by two different potentials applied thereto, said element having a response frequency greater than a ringing frequency of the potentials applied, comprising:

first application means for applying a first potential to the element;

second application means for applying a second potential to the element; and delay means for providing a delay time following application of the first potential in order to delay application of the second potential;

said delay time being set to be longer than a time required for a ringing waveform, which is produced by application of the first potential, to be damped so that when the second potential is applied, the element will no longer be destroyed by a voltage that is the difference between the two potentials applied to said element.

44. The apparatus according to claim 43, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

45. The apparatus according to claim 44, wherein said first application means applies the first potential to a plurality of row-direction wires while selecting these row-direction wires sequentially.

46. The apparatus -according to claim 44, wherein said second application means applies the second potential based upon an image signal.

47. The apparatus according to claim 43, wherein the first and second potentials are set to values that will not cause the element to be driven when the first potential is being applied and the second potential is not.

48. The apparatus according to claim 43, wherein said element is driven by a voltage which is a difference between the two different potentials which are applied thereto via two wirings, said first application means applies the first potential to one of the two wirings and said second application means applies the second potential to the other.

49. A drive apparatus for driving an element by two different potentials applied thereto, said element having a response frequency greater than a ringing frequency of the potentials applied, comprising:

first application means for applying a first potential to the element;

second application means for applying a second potential to the element; and delay means for providing a delay time following application of the first potential in order to delay application of the second potential;

said delay time being set to be longer than a time required for a ringing waveform, which is produced by application of the first potential, to be damped so that when the second potential is applied, a change in a characteristic of the element caused by a voltage that is the difference between the two potentials applied to said element will fall within an allowable range.

50. The apparatus according to claim 49, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

51. The apparatus according to claim 50, wherein said first application means applies the first potential to a plurality of row-direction wires while selecting these row-direction wires sequentially.

52. The apparatus according to claim 50, wherein said second application means applies the second potential based upon an image signal.

53. The apparatus according to claim 49, wherein the first and second potentials are set to values that will not cause the element to be driven when the first potential is being applied and the second potential is not.

54. The apparatus according to claim 49, wherein said element is driven by a voltage which is a difference between the two different potentials which are applied thereto via two wirings, said first application means applies the first potential to one of the two wirings and said second application means applies the second potential to the other.

55. A drive apparatus for driving an element driven by two different potentials applied thereto, said element having a response frequency greater than a ringing frequency of the potentials applied, comprising:

first application means for applying a second potential to the element;

second application means for applying a second potential to the element; and delay means for providing a delay time following application of the first potential in order to delay application of the second potential;

said delay time being set to be longer than a time required for a ringing waveform, which is produced by application of the first potential, to be damped so that when the second potential is applied, a change in state of drive of the element caused by a voltage that is the difference between the two potentials applied to said element will fall within an allowable range.

56. The apparatus according to claim 55, wherein said first application means applies the first potential to a row-direction wire of a multiple-element device obtained by wiring a plurality of said elements two-dimensionally into a matrix; and said second application means applies the second potential to a column-direction wire of said multiple-element device in state in which the first potential is being applied by said first application means.

57. The apparatus according to claim 58, wherein said first application means applies the first potential to a plurality of row-direction wires while selecting these row-direction wires sequentially.

58. The apparatus according to claim 56, wherein said second application means applies the second potential based upon an image signal.

59. The apparatus according to claim 55, wherein the first and second potentials are set to values that will not cause the element to be driven when the first potential is being applied and the second potential is not.

60. The apparatus according to claim 55, wherein said element is driven by a voltage which is a difference between the two different potentials which are applied thereto via two wirings, said first application means applies the first potential to one of the two wirings and said second application means applies the second potential to the other.

61. A drive method for driving an electron emission element driven by two different potentials applied thereto, comprising:

a first application step of applying a first potential to the electron emission element; and a second application step of applying a second potential to the electron emission element;

a delay time being provided following application of the first potential in order to delay application of the second potential, said de lay time being set to be longer than a time required for a ringing waveform, which is produced by application of the first potential, to be damped to 1%.

62. The drive method according to claim 61, wherein the electron emission element is a cold cathode element, the cold cathode element is driven by a voltage which is a difference between the two different potentials which are applied thereto via two wirings, said first application step applies the first potential to one of the two wirings and said second application step applies the second potential to the other.

63. A drive method for driving an electron source device obtained by connecting, by wiring, an electron emission element driven by two different potentials applied thereto, comprising:

a first application step of applying a first potential to the electron emission element; and a second application step of applying a second potential to the electron emission element;

a delay time Td being provided following application of the first potential in order to delay application of the second potential, said delay time Td satisfying the following inequality when R, C and L represent a resistance value, capacitance component and inductance component of the electron source device, respectively:

$$Td>(0.733/\zeta)\times(2\pi/\omega_0)$$

where $$\zeta=1/(2R)\times\sqrt{(L/C)},\ \omega_0=1\sqrt{(L/C)}.$$

64. The drive method according to claim 63, wherein the electron emission element is a cold cathode element, the cold cathode element is driven by a voltage which is a difference between the two different potentials which are applied thereto via two wirings, said first application step applies the first potential to one of the two wirings and said second application step applies the second potential to the other.

65. A drive method for driving an electron emission element driven by two different potentials applied thereto, comprising:

a first application step of applying a first potential to the electron emission element; and a second application step of applying a second potential to the electron emission element;

a delay time being provided following application of the first potential in order to delay application of the second potential, said delay time being set to be longer than a time required for a ringing waveform, which is produced by application of the first potential, to be damped so that when the second potential is applied, the electron emission element will no longer be destroyed by a voltage that is the difference between the two potentials applied to said electron emission element.

66. The drive method according to claim 65, wherein the electron emission element is a cold cathode element, the cold cathode element is driven by a voltage which is a difference between the two different potentials which are applied thereto via two wirings, said first application step applies the first potential to one of the two wirings and said second application step applies the second potential to the other.

67. A drive method for driving an electron emission element driven by two different potentials applied thereto, comprising:

a first application step of applying a first potential to the electron emission element; and a second application step of applying a second potential to the electron emission element;

a delay time being provided following application of the first potential in order to delay application of the second potential, said delay time being set to be longer than a time required for a ringing waveform, which is produced by application of the first potential, to be damped so that when the second potential is applied, a change in a characteristic of the electron emission element caused by a voltage that is the difference between the two potentials applied to said electron emission element will fall within an allowable range.

68. The drive method according to claim 67, wherein the electron emission element is a cold cathode element, the cold cathode element is driven by a voltage which is a difference between the two different potentials which are applied thereto via two wirings, said first application step applies the first potential to one of the two wirings and said second application step applies the second potential to the other.

69. A drive method for driving an electron emission element driven by two different potentials applied thereto, comprising:

a first application step of applying a first potential to the electron emission element; and a second application step of applying a second potential to the electron emission element;

a delay time being provided following application of the first potential in order to delay application of the second potential, said delay time being set to be longer than a time required for a ringing waveform, which is produced by application of the first potential, to be damped so that when the second potential is applied, a change in state of drive of the electron emission element caused by a voltage that is the difference between the two potentials applied to said electron emission element will fall within an allowable range.

70. The drive method according to claim 69, wherein the electron emission element is a cold cathode element, the cold cathode element is driven by a voltage which is a difference between the two different potentials which are applied thereto via two wirings, said first application step applies the first potential to one of the two wirings and said second application step applies the second potential to the other.

71. A drive method for driving an element driven by two different potentials applied thereto, said element having a response frequency greater than a ringing frequency of the potentials applied, comprising:

a first application step of applying a first potential to the element; and a second application step of applying a second potential to the element;

a delay time being provided following application of the first potential in order to delay application of the second potential, said delay time being set to be longer than a time required for a ringing waveform, which is produced by application of the first potential, to be damped to 1%.

72. The drive method according to claim 71, wherein the element is driven by a voltage which is a difference between the two different potentials which are applied thereto via two wirings, said first application step applies the first potential to one of the two wirings and said second application step applies the second potential to the other.

73. A drive method for driving an electron source device obtained by connecting, by wiring, an element driven by two different potentials applied thereto, comprising:

a first application step of applying a first potential to the element; and a second application step of applying a second potential to the element;

a delay time Td being provided following application of the first potential in order to delay application of the second potential, said delay time Td satisfying the following inequality when R, C and L represent a resistance value, capacitance component and inductance component of the electron source device, respectively:

$$Td>(0.733/\zeta)\times(2\pi/\omega_0)$$

where $$\zeta=1/(2R)\times\sqrt{(L/C)},\ \omega_0=\sqrt{(L/C)};$$

said element having a response frequency that is greater than $\omega_0$.

74. The drive method according to claim 73, wherein the element is an electron emission element, the electron emission element is driven by a voltage which is a difference between the two different potentials which are applied thereto via two wirings, said first application step applies the first potential to one of the two wirings and said second application step applies the second potential to the other.

75. A drive method for driving an element driven by two different potentials applied thereto, said element having a response frequency greater than a ringing frequency of the potentials applied, comprising:

a first application step of applying a first potential to the element; and a second application step of applying a second potential to the element;

a delay time being provided following application of the first potential in order to delay application of the second potential, said delay time being set to be longer than a time required for a ringing waveform, which is produced by application of the first potential, to be damped so that when the second potential is applied, the element will no longer be destroyed by a voltage that is the difference between the two potentials applied to said element.

76. The drive method according to claim 75, wherein the element is driven by a voltage which is a difference between the two different potentials which are applied thereto via two wirings, said first application step applies the first potential to one of the two wirings and said second application step applies the second potential to the other.

77. A drive method for driving an element driven by to different potentials applied thereto, said element having a response frequency greater than a ringing frequency of the potentials applied, comprising:

a first application step of applying a first potential to the element; and a second application step of applying a second potential to the element;

a delay time being provided following application of the first potential in order to delay application of the second potential, said delay time being set to be longer than a time required for a ringing waveform, which is produced by application of the first potential, to be damped so that when the second potential is applied, a change in a characteristic of the element caused by a voltage that is the difference between two potentials applied to said element will fall within an allowable range.

78. The drive method according to claim 77, wherein the element is driven by a voltage which is a difference between the two different potentials which are applied thereto via two wirings, said first application step applies the first potential to one of the two wirings and said second application step applies the second potential to the other.

79. A drive method for driving an element by two different potentials applied thereto, said element having a response frequency greater than a ringing frequency of the potentials applied, comprising:

a first application step of applying a first potential to the element; and a second application step of applying a second potential to the element;

a delay time being provided following application of the first potential in order to delay application of the second potential, said delay time being set to be longer than a time required for a ringing waveform, which is produced by application of the first potential, to be damped so that when the second potential is applied, a change in state of drive of the element caused by a voltage that is the difference between the two potentials applied to said element will fall within an allowable range.

80. The drive method according to claim 79, wherein the element is driven by a voltage which is a difference between the two different potentials which are applied thereto via two wirings, said first application step applies the first potential to one of the two wirings and said second application step applies the second potential to the other.

81. An image forming apparatus comprising:

an electron emission element driven by two different potentials applied thereto;

first application means for applying a first potential to the electron emission element;

second application means for applying a second potential to the electron emission element;

delay means for providing a delay time following application of the first potential in order to delay application of the second potential; and an image forming member on which an image is formed by driving of said electron emission element;

said delay time being set to be longer than a time required for a ringing waveform, which is produced by application of the first potential, to be damped to 1%.

82. The apparatus according to claim 81, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

83. An image forming apparatus comprising:

an electron source device obtained by connecting, by wiring, an electron emission element driven by two different potentials applied thereto;

first application means for applying a first potential to the electron emission element;

second application means for applying a second potential to the electron emission element;

delay means for providing a delay time Td following application of the first potential in order to delay application of the second potential; and an image forming member on which an image is formed by driving of said electron emission element;

said delay time Td satisfying the following inequality when R, C and L represent a resistance value, capacitance component and inductance component of the electron source device, respectively:

$$Td>(0.733/\zeta)\times(2\pi/\omega_0)$$

where $$\zeta=1/(2R)\times\sqrt{(L/C)},\ \omega_0=\sqrt{(L/C)}.$$

84. The apparatus according to claim 83, wherein the electron emission element is a cold cathode element, the cold cathode element is driven by a voltage which is a difference between the two different potentials which are applied thereto via two wirings, said first application means applies the first potential to one of the two wirings and said second application means applies the second potential to the other.

85. An image forming apparatus comprising:

an electron emission element driven by two different potentials applied thereto;

first application means for applying a first potential to the electron emission element;

second application means for applying a second potential to the electron emission element;

delay means for providing a delay time following application of the first potential in order to delay application of the second potential; and an image forming -member on which an image is formed by driving of said electron emission element;

said delay time being set to be longer than a time required for a ringing waveform, which is produced by application of the first potential, to be damped so that when the second potential is applied, the electron emission element will no longer be destroyed by a voltage that is the difference between the two potentials applied to said electron emission element.

86. The apparatus according to claim 85, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

87. An image forming apparatus comprising:

an electron emission element driven by two different potentials applied thereto;

first application means for applying a first potential to the electron emission element;

second application means for applying a second potential to the electron emission element;

delay means for providing a delay time following application of the first potential in order to delay application of the second potential; and an image forming member on which an image is formed by driving of said electron emission element;

said delay time being set to be longer than a time required for a ringing waveform, which is produced by application of the first potential, to be damped so that when the second potential is applied, a change in a characteristic of the electron emission element caused by a voltage that is the difference between the two potentials applied to said electron emission element will fall within an allowable range.

88. The apparatus according to claim 85, wherein said electron emission element is a cold cathode element , said cold cathode element is driven by a voltage which is a difference between the two different potentials which are applied thereto via two wirings, said first application means applies the first potential to one of the two wirings and said second application means applies the second potential to the other.

89. An image forming apparatus comprising:

an electron emission element driven by two different potentials applied thereto;

first application means for applying a first potential to the electron emission element;

second application means for applying a second potential to the electron emission element;

delay means for providing a delay time following application of the first potential in order to delay application of the second potential; and an image forming member on which an image is formed by driving of said electron emission element;

said delay time being set to be longer than a time required for a ringing waveform, which is produced by application of the first potential, to be damped so that when the second potential is applied, a change in state of drive of the electron emission element caused by a voltage that is the difference between the two potentials applied to said electron emission element will fall within an allowable range.

90. The apparatus according to claim 89, wherein said electron emission element is a cold cathode element, said cold cathode element is driven by a voltage which is a difference between the two different potentials which are applied thereto via two wirings, said first application means applies the first potential to one of the two wirings and said second application means applies the second potential to the other.

91. An image forming apparatus comprising:

an element driven by two different potentials applied thereto, said element having a response frequency greater than a ringing frequency of the potentials applied;

first application means for applying a first potential to the element;

second application means for applying a second potential to the element;

delay means for providing a delay time following application of the first potential in order to delay application of the second potential; and an image forming member on which an image is formed by driving of said element;

said delay time being set to be longer than a time required for a ringing waveform, which is produced by application of the first potential, to be damped to 1%.

92. The apparatus according to claim 91, wherein said element is driven by a voltage which is a difference between the two different potentials which are applied thereto via two wirings, said first application means applies the first potential to one of the two wirings and said second application means applies the second potential to the other.

93. An image forming apparatus comprising:

an electron source device obtained by connecting, by wiring, an element driven by two different potentials applied thereto;

first application means for applying a first potential to the element;

second application means for applying a second potential to the element;

delay means for providing a delay time Td following application of the first potential in order to delay application of the second potential; and an image forming member on which an image is formed by driving of said element;

said delay time Td satisfying the following inequality when R, C and L represent a resistance value, capacitance component and inductance component of the electron source device, respectively:

$$Td>(0.733/\zeta)\times(2\pi/\omega_0)$$

where $$\zeta=1/(2R)\times\sqrt{(L/C)},\ \omega_0=\sqrt{(L/C)};$$

said element having a response frequency that is greater than $\omega_0$.

94. The apparatus according to claim 93, wherein said element is an electron emission element, the electron emission element is driven by a voltage which is a difference between the two different potentials which are applied thereto via two wirings, said first application means applies the first potential to one of the two wirings and said second application means applies the second potential to the other.

95. An image forming apparatus comprising:

an element driven by two different potentials applied thereto, said element having a response frequency greater than a ringing frequency of the potentials applied;

first application means for applying a first potential to the element;

second application means for applying a second potential to the element;

delay means for providing a delay time following application of the first potential in order to delay application of the second potential; and an image forming member on which an image is formed by driving of said element;

said delay time being set to be longer than a time required for a ringing waveform, which is produced by application of the first potential, to be damped so that when the second potential is applied, the element will no longer be destroyed by a voltage that is the difference between the two potentials applied to said element.

96. The apparatus according to claim 95, wherein said element is driven by a voltage which is a difference between the two different potentials which are applied thereto via two wirings, said first application means applies the first potential to one of the two wirings and said second application means applies the second potential to the other.

97. An image forming apparatus comprising:

an element driven by two different potentials applied thereto, said element having a response frequency greater than a ringing frequency of the potentials applied;

first application means for applying a first potential to the element;

second application means for applying a second potential to the element;

delay means for providing a delay time following application of the first potential in order to delay application of the second potential; and an image forming member on which an image is formed by driving of said element;

said delay time being set to be longer than a time required for a ringing waveform, which is produced by application of the first potential, to be damped so that when the second potential is applied, a change in a characteristic of the element caused by a voltage that is the difference between the two potentials applied to said element will fall within an allowable range.

98. The apparatus according to claim 97, wherein said element is driven by a voltage which is a difference between the two different potentials which are applied thereto via two wirings, said first application means applies the first potential to one of the two wirings and said second application means applies the second potential to the other.

99. An image forming apparatus comprising:

an element driven by two different potentials applied thereto, said element having a response frequency greater than a ringing frequency of the potentials applied;

first application means for applying a first potential to the element;

second application means for applying a second potential to the element;

delay means for providing a delay time following application of the first potential in order to delay application of the second potential; and an image forming member on which an image is formed by driving of said element;

said delay time being set to be longer than a time required for a ringing waveform , which is produced by application of the first potential, to be damped so that when the second potential is applied, a change in state of drive of the element caused by a voltage that is the difference between the two potentials applied to said element will fall within an allowable range ease.

100. The apparatus according to claim 99, wherein said element is driven by a voltage which is a difference between the two different potentials which are applied thereto via two wirings, said first application means applies the first potential to one of the two wirings and said second application means applies the second potential to the other.

* * * * *

UNITED STATES PATENT AND TRADEMARK OFFICE

CERTIFICATE OF CORRECTION

PATENT NO. : 6,236,167 B1 
DATED : May 22, 2001
INVENTOR(S) : Eiji Yamaguchi et al.

It is certified that error appears in the above-identified patent and that said Letters Patent is hereby corrected as shown below:

Title page,
Item [56], FOREIGN PATENT DOCUMENTS, “09134147” should read
-- 9-134147 --.

Column 1,
Line 22, “Advance” should read -- Advances --.
Line 42, “E.-D.” should read -- E.D. --.
Line 66, “et al. ,” should read -- et al., --.

Column 6,
Line 18, “$\omega_0\sqrt{L/C}$)” should read -- $\omega_0 = \sqrt{L/C}$); --.

Column 9,
1st form, “$V(t)=1-[\zeta/\sqrt{(1\zeta^2)}*\sin(1-\zeta^2)$” should read -- $V(t)=1-[\zeta/\sqrt{(1-\zeta^2)}*\sin(\sqrt{1-\zeta^2})$ --.
1st form, “$*\omega_0 t+\cos(\sqrt{(1\zeta^2)}*(\omega_0 t]*\exp(-\zeta\omega_0 t)$” should read
-- $*\omega_0 t)+\cos(\sqrt{(1-\zeta^2)}*\omega_0 t]*\exp(-\zeta\omega_0 t)$ --.

Column 10,
Line 5, “$\omega_0$and” should read -- $\omega_0$ and --

Column 11,
Line 9, “gH.” should read -- чH. --.

Column 12,
Line 57, “a” should read -- are --.
Line 58, “recoated” should read -- coated --.

Column 13,
Line 46, “pump, not shown,” should read -- pump (not shown) --.

Column 14,
Line 11, “used” should read -- use --.
Line 24, “of a” should read -- of --.

Column 15,
Line 32, “Ångstr” should read -- Ång- --.
Line 33, “öms.” should read -- ströms, --.
Line 45, $10^{7\ \Omega\pi.}$” should read -- $10^7\ \Omega\pi$. --.

Column 22,
Line 38, “suitable” should read -- suitably --.

UNITED STATES PATENT AND TRADEMARK OFFICE

CERTIFICATE OF CORRECTION

PATENT NO. : 6,236,167 B1
DATED : May 22, 2001
INVENTOR(S) : Eiji Yamaguchi et al.

It is certified that error appears in the above-identified patent and that said Letters Patent is hereby corrected as shown below:

Column 25,
Line 14, “state” should read -- the state --.
Line 42, “and delay” should read -- and ¶ delay --.
Line 64, “state” should read -- the state --.

Column 26,
Line 42, “state” should read -- the state --.

Column 27,
Line 21, “state” should read -- the state --.
Line 59, “to-said” should read -- to said --.

Column 28,
Line 44, “state” should read -- the state --.

Column 29,
Line 25, “state” should read -- the state --.

Column 30,
Line 47, “state” should read -- the state --.

Column 31,
Line 23, “state” should read -- the state --.
Line 25, “58,” should read -- 56, --.
Line 52, “de lay” should read -- delay --.

Column 34,
Line 36, “to” should read -- two --.

UNITED STATES PATENT AND TRADEMARK OFFICE

CERTIFICATE OF CORRECTION

PATENT NO. : 6,236,167 B1
DATED : May 22, 2001
INVENTOR(S) : Eiji Yamaguchi et al.

It is certified that error appears in the above-identified patent and that said Letters Patent is hereby corrected as shown below:

Column 36,
Line 15, "-member" should read -- member --.
Line 52, "85," should read -- 87, --.
Line 53, "element ," should read -- element, --.

Signed and Sealed this

Second Day of July, 2002

*Attest:*

*Attesting Officer*

JAMES E. ROGAN
*Director of the United States Patent and Trademark Office*